US010442221B2

(12) United States Patent
Aihara et al.

(10) Patent No.: US 10,442,221 B2
(45) Date of Patent: Oct. 15, 2019

(54) MEDIUM CONVEYING APPARATUS AND IMAGE FORMING APPARATUS

(71) Applicants: Yuichi Aihara, Yamanashi-ken (JP); Kota Hihara, Yamanashi (JP)

(72) Inventors: Yuichi Aihara, Yamanashi-ken (JP); Kota Hihara, Yamanashi (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 0 days.

(21) Appl. No.: 15/790,617

(22) Filed: Oct. 23, 2017

(65) Prior Publication Data

US 2018/0111396 A1 Apr. 26, 2018

(30) Foreign Application Priority Data

Oct. 21, 2016 (JP) ..... 2016-206659

(51) Int. Cl.

| | |
|---|---|
| ***B41J 13/00*** | (2006.01) |
| ***B41J 13/12*** | (2006.01) |
| ***B65H 5/06*** | (2006.01) |
| ***B65H 5/18*** | (2006.01) |
| ***B41J 2/32*** | (2006.01) |
| ***B65H 5/26*** | (2006.01) |
| ***B65H 7/12*** | (2006.01) |

(Continued)

(52) U.S. Cl.

CPC ..... *B41J 13/12* (2013.01); *B41J 2/32* (2013.01); *B41J 13/0009* (2013.01); *B65H 5/06* (2013.01); *B65H 5/062* (2013.01); *B65H 5/18* (2013.01); *B65H 5/26* (2013.01); *B65H 7/12* (2013.01); *B65H 15/00* (2013.01); *B65H 1/025* (2013.01); *B65H 1/027* (2013.01); *B65H 2404/1421* (2013.01); *B65H 2405/31* (2013.01); *B65H 2511/33* (2013.01); *B65H 2511/524* (2013.01); *B65H 2513/53* (2013.01); *B65H 2553/82* (2013.01); *B65H 2701/1914* (2013.01)

(58) Field of Classification Search

CPC ..... B41J 13/009; B65H 5/06

See application file for complete search history.

(56) References Cited

U.S. PATENT DOCUMENTS

| | | | | |
|---|---|---|---|---|
| 2005/0083395 | A1* | 4/2005 | Kubota | B41J 2/325 347/215 |
| 2012/0286464 | A1* | 11/2012 | Takei | B41J 13/12 271/4.01 |
| 2018/0111387 | A1* | 4/2018 | Aihara | B41J 2/32 |

FOREIGN PATENT DOCUMENTS

| | | | |
|---|---|---|---|
| JP | 2008-162113 | A | 7/2008 |
| JP | 2011-209909 | A | 10/2011 |
| JP | 2013-040039 | A | 2/2013 |

* cited by examiner

*Primary Examiner* — Kristal Feggins
*Assistant Examiner* — Kendrick X Liu
(74) *Attorney, Agent, or Firm* — Manabu Kanesaka

(57) ABSTRACT

Disclosed herein is a medium conveying apparatus in which the time for unjamming can be shortened. The medium conveying apparatus includes rollers configured to convey a card Ca, a rotary unit F provided in a medium conveyance path and configured to hold and rotate the card Ca, a sensor SN26 arranged downstream the rotary unit F on the medium conveyance path and, and a control section. The control section controls a first card-conveyance motor for driving the rollers to convey the card Ca into the rotary unit F, and determines whether the sensor SN26 detects the card Ca. The sensor SN26 is arranged at the same distance as a sensor SN3 or a shorter distance than the sensor SN3, from the rotary unit F.

12 Claims, 15 Drawing Sheets

(51) Int. Cl.

| | |
|---|---|
| ***B65H 15/00*** | (2006.01) |
| *B65H 1/02* | (2006.01) |

MEDIUM CONVEYING APPARATUS AND IMAGE FORMING APPARATUS

BACKGROUND OF THE INVENTION

Field of the Invention

This invention relates to a medium conveying apparatus and an image forming apparatus, more particularly to a medium conveying apparatus having a direction changing section for changing the direction of conveying media and to an image forming apparatus having this medium conveying apparatus.

Description of the Related Art

Hitherto known well is an image forming apparatus that forms an image on a hard medium such as a card or a disc or on a semi-hard medium. An image forming apparatus of this type performs indirect printing or direct printing. In the indirect printing, an ink ribbon is used, forming an image (i.e., mirror image) on a transfer film, and the image is transferred from the transfer film onto one side of a medium. In the direct printing, an ink ribbon is used, forming an image directly on one side of a medium.

In such an image forming apparatus, the image forming section forms an image on the medium held between the platen roller and the thermal head as heat is applied to the thermal head through the ink ribbon in accordance with print data. Today, color printing is widely performed, forming images of different colors, one image overlapping another.

Among these apparatuses, an image forming apparatus is known, which includes a direction changing section for changing the direction of conveying a medium so that the apparatus may be compact. Patent Document 1, for example, discloses a medium conveying apparatus having a rotary member (reversing unit F) configured to rotate a card and sensors arranged around the rotary member. In this apparatus, if the card conveyed is longer than the card of standard size, the card protruding from the reversing unit F may interfere with the sensors arranged around the reversing unit F. In view of this, it is determined whether the reversing unit F can rotate (or can change the card conveyance direction) and whether multi-feeding occurs (whether two or more cards are conveyed, though one card should be conveyed). The card conveyance distance is detected from how much rollers 14 are driven between the time when the sensor Se1 arranged downstream the reversing unit F in the card conveyance direction detects the front end of the card and the time when the sensor Se1 detects the rear end of the card.

Patent Document 2 discloses a direction changing section that can change the card conveyance direction while the card is being held (nipped) though it cannot turn the card upside down (rotate it by 180°) as in the apparatus disclosed in Patent Document 1. Patent Document 3 discloses a common technique of measuring the length of a medium, i.e., sheet.

Prior Art Document

Patent Document

[Patent Document 1] Japanese Patent Application Publication No. 2011-209909 (see FIG. 3, reference numeral F)

[Patent Document 2] Japanese Patent Application Publication No. 2008-162113 (see FIG. 10, reference numeral 60)

[Patent Document 3] Japanese Patent Application Publication No. 2013-040039 (see FIGS. 2 and 8)

In the apparatus disclosed Patent Document 1, the rollers 14 arranged upstream the reversing unit F and the sensor Se1 are used to detect the distance the card is conveyed. Therefore, the card is nipped by the rollers 14 when its front end reaches the sensor Se1, and then supplied from the rollers 14 to the rollers 20 provided in the reversing unit F. When the rear end of the card reaches the sensor Se1, the card is no longer nipped by the rollers 14 and is nipped by the rollers 20. Unlike in a single linear conveyance path, the reversing unit F rotates, switching the conveyance path to another. Inevitably, the card may be erroneously conveyed. This may result in an error in determining whether the reversing unit F can rotate or whether cards are multi-fed.

In the apparatus disclosed Patent Document 1, the distance the card is conveyed from the time when the sensor Se1 detects the rear end of the card detects to the time when a sensor arranged downstream the reversing unit F in the card conveyance direction detects the front end of the card may be detected. Then, the sensor Se1 detects the rear end of the card Ca after the card Ca is conveyed from the rollers 14 to the rollers 20. Therefore, no conveyance error is made, and it can be determined, with high precision, whether the reversing unit F can be rotated and whether multi-feeding of cards occurs. However, the card must be conveyed to have its front end reach the downstream-side sensor so that it may be determined whether the reversing unit F can be rotated and whether multi-feeding of cards has occurred. The process time, including the time for conveying the card, will inevitably increase.

SUMMARY OF THE INVENTION

In view of the above, this invention has been made. The object of this invention is to provide a medium conveying apparatus in which the process time can be shortened, and an image forming apparatus which includes this medium conveying apparatus.

To achieve the object, a first aspect of the invention is a medium conveying apparatus including: a conveyance section configured to convey a medium; a direction changing section provided on a medium conveyance path of the conveyance section and configured to change the direction in which the medium is conveyed by the conveyance section; a first sensor arranged downstream the direction changing section, on the medium conveyance path; and a control section configured to control the conveyance section and the direction changing section. The control section controls the conveyance section, thereby to convey the medium into the direction changing section, and determines whether the first sensor has detected the medium.

In the first aspect of the invention, the medium conveying apparatus may further includes a second sensor arranged on the circumference of the direction changing section and on another medium conveyance path for conveying the medium in another direction different from that of the medium conveyance path. The first sensor may preferably be arranged at the same distance from the direction changing section as the second sensor, or at a shorter distance from the direction changing section than the second sensor. Further, the apparatus may further include a third sensor arranged upstream the direction changing section, on the medium conveyance path, and the control section may control the conveyance section, thereby conveying the medium for a preset distance toward the direction changing section from the time when the third sensor detects an end of the medium, and then conveying the medium into the direction changing section. In this case, the control section may control the conveyance section, thereby to convey the medium for a preset distance toward the direction changing section from the time when the third sensor detects the rear end of the medium, and then to convey the medium into the direction changing section.

Further, unless the first sensor detects the medium when the medium is conveyed for the preset distance toward the direction changing section, the control section may control the direction changing section to change the direction of conveying the medium, thereby to convey the medium toward the other medium conveyance path. Still further, if the first sensor detects the medium when the medium is conveyed for the preset distance toward the direction changing section, the control section may control the direction changing section to convey the medium back upstream the direction changing section, on the medium conveyance path.

Moreover, the direction changing section may be a rotary member configured to hold and rotate the medium and may have pairs of rollers constituting a part of the conveyance section.

To achieve the object, a second aspect of the invention is an image forming apparatus including: an image forming section configured to form an image on the medium; and a medium conveying apparatus according to the first aspect of the invention.

In this invention, the control section controls the conveyance section, thereby conveying a medium into the direction changing section and determining whether the first sensor detects the medium. Hence, without conveying the medium to the first sensor, it can be determined whether the direction changing section can change the direction of conveying the medium. This results in the advantage of shortening the process time.

BRIEF DESCRIPTION OF THE DRAWINGS

FIG. 11A showing the cards supplied to the rotary unit, FIG. 11B showing the rotary unit rotated, while clamping the multi-fed cards, and FIG. 11C showing the cards having their front ends reaching the sensor for detecting the front ends the multi-fed cards in the horizontal medium conveyance path;

FIG. 12A showing the multi-fed cards held with their center parts positioned at the rotation center of the rotary unit, FIG. 12B showing the rotary unit rotated, positioning the multi-fed cards in the direction to be delivered as erroneously conveyed ones, and FIG. 12C shows the multi-fed cards being delivered toward the rejected-sheet stacker;

FIG. 13A showing the rotary unit rotatable, and FIG. 13B showing the rotary unit not rotatable;

FIG. 16A showing the multi-fed cards rotated in the direction to be ejected as erroneous ones and held, at one end, by the rollers, FIG. 16B showing the multi-fed cards rotated toward the noncontact IC recording unit and held, atone end, by the rollers, and FIG. 16C showing the multi-fed cards held by a pair of conveyance rollers provided in the horizontal medium conveyance path.

DESCRIPTION OF THE EMBODIMENTS

Hereinafter, an embodiment of this invention will be described as a printing apparatus designed to print characters or an image on a card and to record information magnetically or electrically on the card.

1. Configuration

1-1 System Configuration

Figure 1:
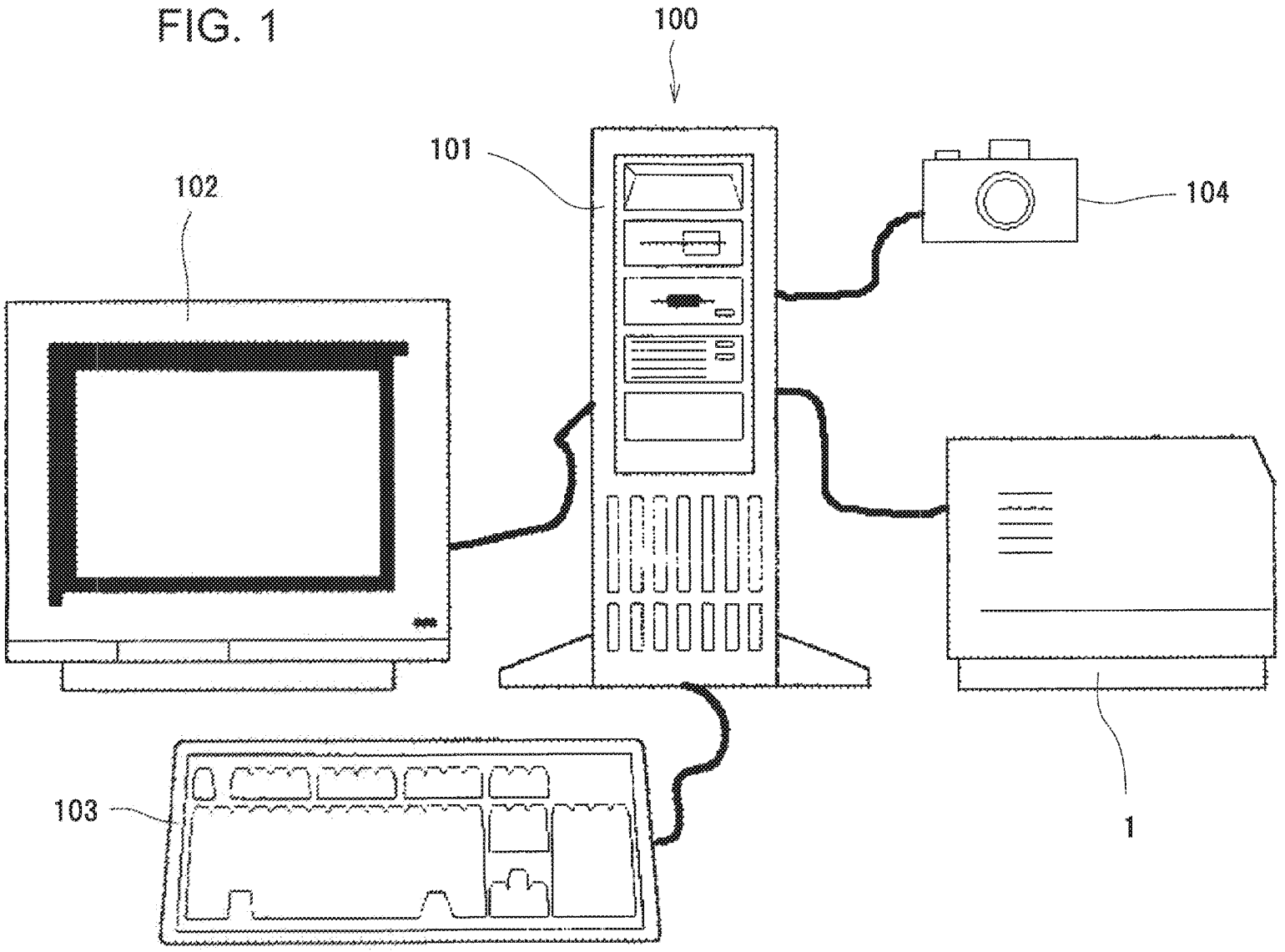
FIG. 1 is an external view schematically showing a printing system including a printing apparatus according to an embodiment of the present invention.
Figure 6:
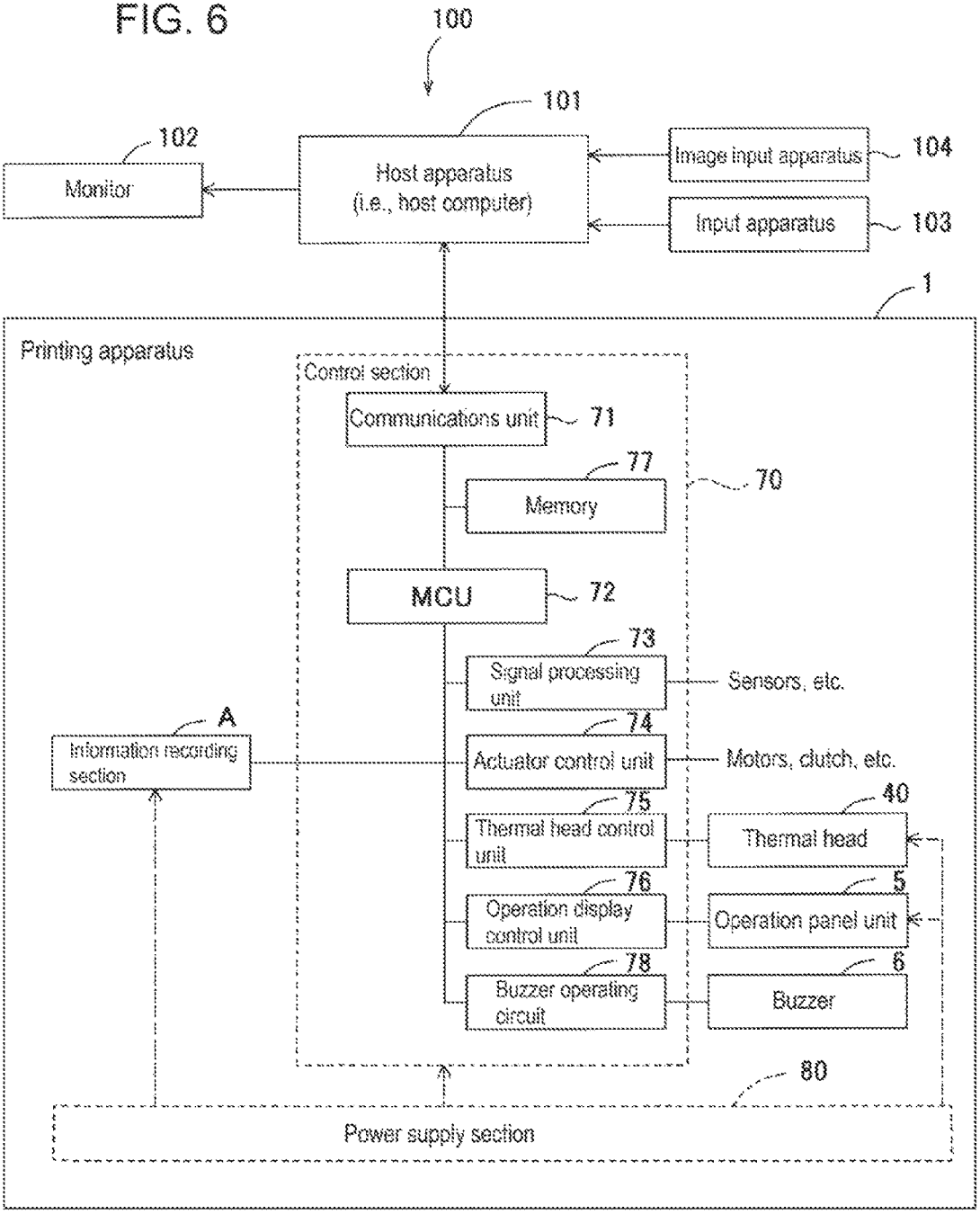
FIG. 6 is a block diagram schematically illustrating the control section of the printing apparatus.

As shown in FIG. 1 and FIG. 6, the printing apparatus 1 according to this embodiment constitutes a part of a printing system 100. The printing system 100 includes a host apparatus 101 (e.g., host computer such as a personal computer) and a printing apparatus 1.

The printing apparatus 1 is connected by an interface (not shown) to the host apparatus 101. The host apparatus 101 can transmits print data, magnetic or electric record data and the like to the printing apparatus 1, to instruct the printing apparatus 1 to print the data. The printing apparatus 1 has an operation panel unit 5 (i.e., operation display unit, see FIG. 3 and FIG. 6), and can record data in accordance with the instructions coming not only from the host apparatus 101 but also from the operation panel unit 5.

To the host apparatus 101, an image input apparatus 104, an input apparatus 103, and a monitor 102 are connected. The image input apparatus 104 (e.g., digital camera or scanner) is configured to input image data. The input apparatus 103 (e.g., keyboard or mouse) is configured to input instructions and data to the host apparatus 101. The monitor 102 (e.g., liquid crystal display) is configured to display the data generated by the host apparatus 101.

1-2 Printing Apparatus 1-2-1 Mechanical Sections

Figure 2:
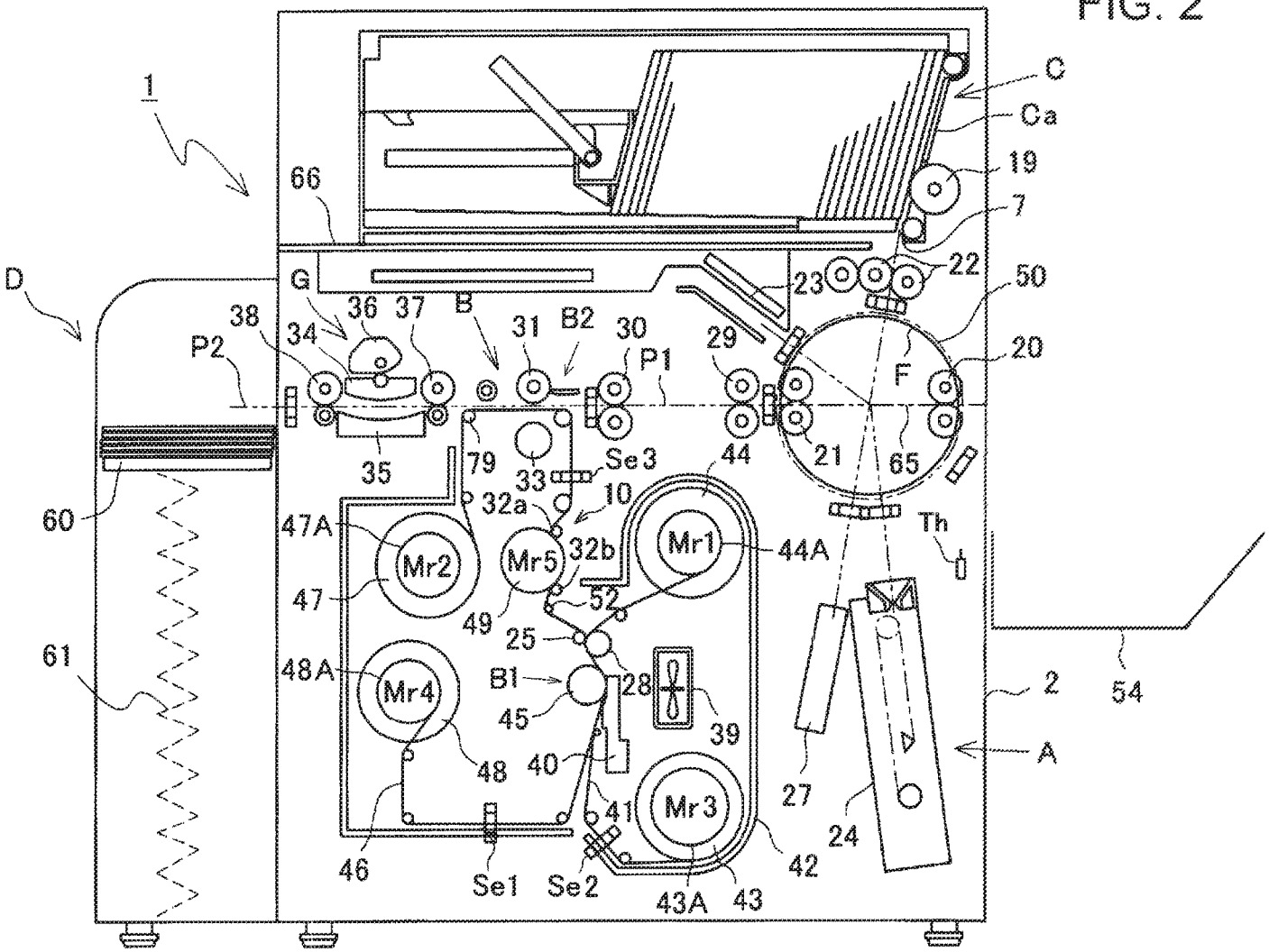
FIG. 2 is a front view schematically showing the configuration of the printing apparatus.

As shown in FIG. 2, the printing apparatus 1 has a housing 2. The housing 2 incorporates an information recording section A, a printing section B, a rotary unit F, and a de-curling mechanism G. The printing apparatus 1 has a medium supplying section C mountable on the housing 2, a medium storing section D, and a rejected-sheet stacker 54. The rejected-sheet stacker 54 is provided on that side of the housing 2, which faces away from the medium storing section D.

(1) Information Recording Section A

The information recording section A is composed of a magnetic recording unit 24, a noncontact IC recording unit 23, and a contact IC recording unit 27. The three recording units are optional components. At least one of them is used in accordance with the user's request.

(2) Medium Supplying Section C

Figure 4:
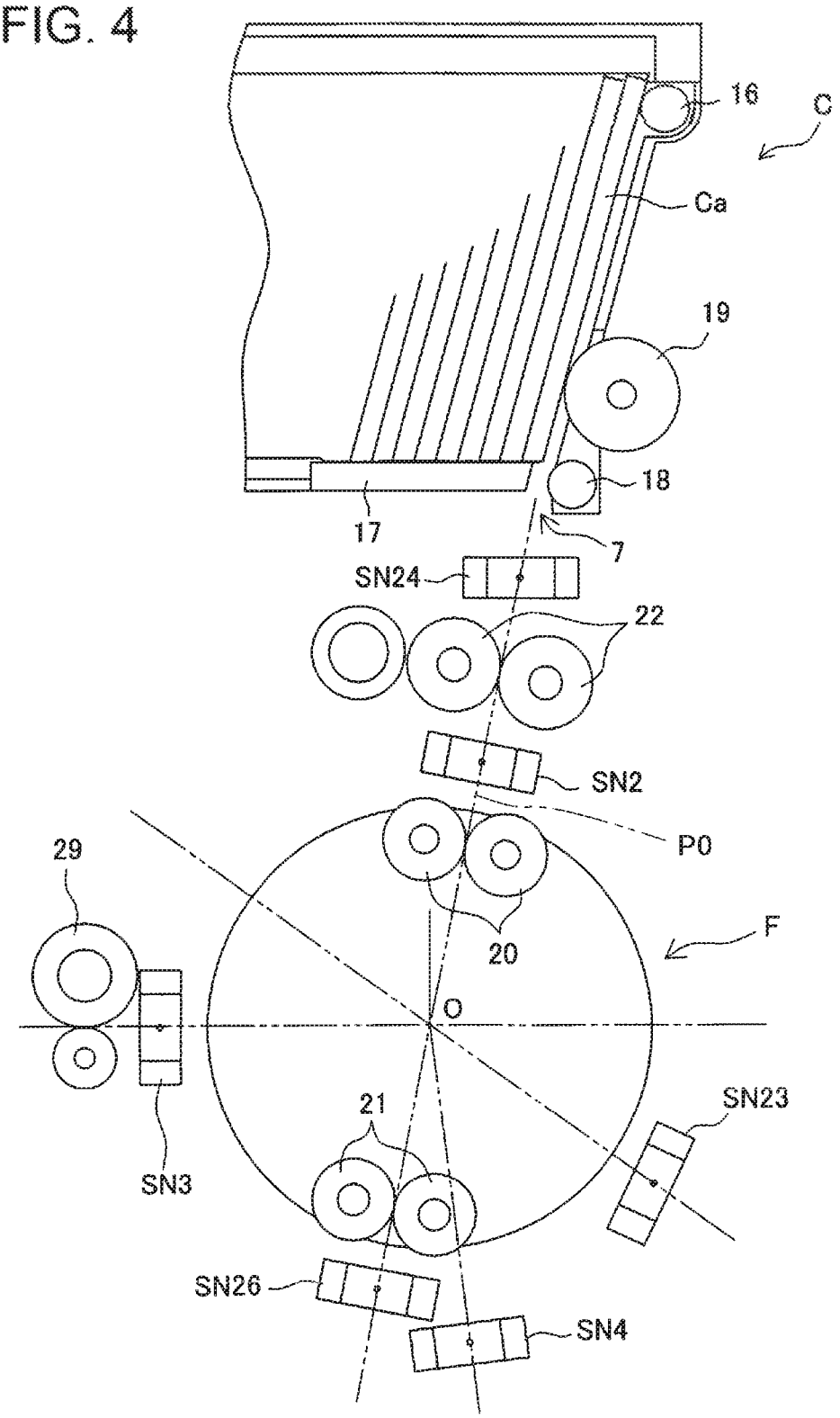
FIG. 4 is a diagram showing where sensors are arranged around the medium supplying section and around a rotary unit.

The medium supplying section C is composed of a card cassette for holding a plurality of cards Ca in standing position (more precisely, held inclined by 10°). In this embodiment, the cards Ca have the standard size, i.e., 85.6 mm (length)×53.9 mm (width). As shown in FIG. 4, an idling roller 16 is arranged above that end of the card cassette, at which the front end (i.e., leading end) of each card lies in the card cassette, and a separating pad 17 is arranged at the bottom of the card cassette. The separating pad 17 is a plate-like resilient member made of material having a large coefficient of friction, such as rubber.

In the housing of the printing apparatus 1, a pickup roller 19 (see FIG. 3) and an idle roller 18 are arranged. The pickup roller 19 is configured to convey the front-most card Ca from the card cassette. The idle roller 18 is arranged below the pickup roller 19 and opposes the separating pad 17. Hence, between the idle roller 18 and the separating pad 17, a card separating opening 7 is provided to separate a card Ca from the next card. The pickup roller 19 is rotated by a pickup motor (e.g., stepping motor, not shown). In this embodiment, the width of the card separating opening 7 can be adjusted in accordance with the thickness of the cards. The operator may rotate the rotary member arranged at the bottom of the card cassette, thereby to move the separating pad 17 toward or away from the idle roller 18.

Figure 3:
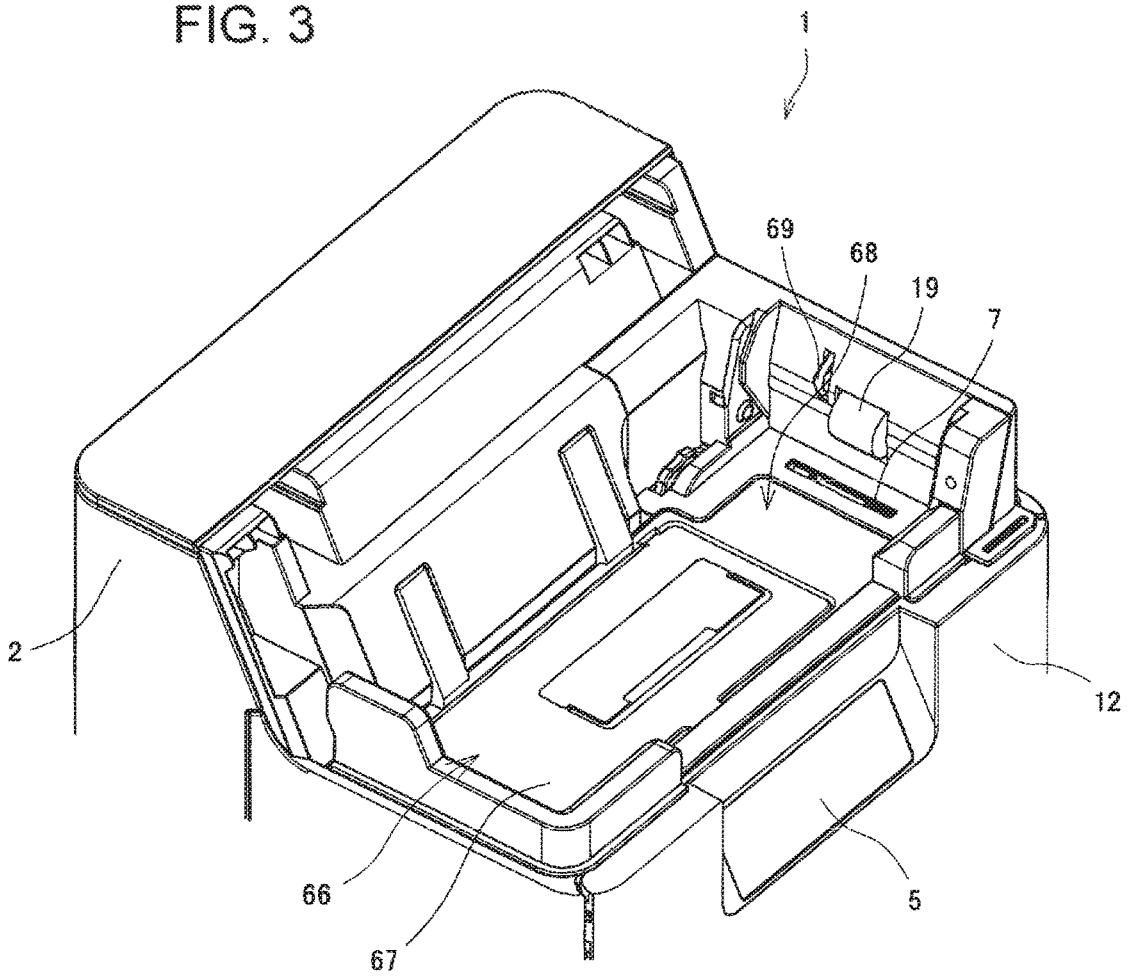
FIG. 3 is an external perspective view of the upper part of the printing apparatus, with its medium supplying section removed.

As may be seen from FIG. 3, the medium supplying section C is secured to the cassette-holding area 68 of the housing 2, and can be removed therefrom. The front part of the card cassette, which constitutes the medium supplying section C, has a rectangular opening (not shown). Through this opening, a sensor lever 69 provided on the housing of the printing apparatus 1 is inserted and abuts on the card Ca. It is thereby determined whether or not cards exist in the card cassette (or whether the medium supplying section C is secured to the housing of the printing apparatus 1).

If the medium supplying section C (i.e., card cassette) is removed from the cassette-holding area 68, an opening-closing member 66 located below the medium supplying section C will be seen from outside. The opening-closing member 66 has an upper cover 67, which constitutes a partition (i.e., bottom wall) that defines the cassette-holding area 68. The opening-closing member 66 is secured to the housing 2, able to be opened and closed, and is supported by the housing 2, able to open and close at longitudinal one end (as viewed in the lengthwise direction). The printing apparatus 1 has, at its front, a front door 12 that can be opened and closed freely.

The medium supplying section C has such a configuration as disclosed in, for example, JP 2012-25511A. The opening-closing member 66 provided in the printing apparatus 1 has such a configuration as disclosed in, for example, JP 2012-123074A.

As shown in FIG. 4, a one-piece transmissive sensor SN24 having a light-emitting element and a light-receiving element is located downstream the card separating opening 7 in the card conveyance direction. Cleaning rollers 22 are arranged downstream the sensor SN24 in the card conveyance direction, to clean the card Ca delivered from the medium supplying section C and to convey the card Ca downstream. The cleaning rollers 22 are adhesive, and remove dust or the like from the card Ca. Further, an adhesive roller 26 is pressed onto one of the cleaning rollers 22, to remove dust or the like from the cleaning rollers 22.

(3) Rotary Unit F

In brief, the rotary unit F has the function of changing the direction in which the medium is conveyed (in this embodiment, the function of conveying the card Ca and rotating the card Ca while holding an end of the card Ca). More specifically, the rotary unit F has a pair of disc-shaped rotary frames 50. (In FIG. 2, only the front-side rotary frame 50 is illustrated. The front-side rotary frame 50 shall hereinafter be distinguished from the rear-side rotary frame 50 not shown, when needed.) The rotary frames 50 (provided in pair) are secured to a spacer (not shown), forming an integral member. The spacer defines a gap between the rotary frames 50.

(3-1) Card Conveyance

As shown in FIG. 4, the rotary unit F has two pairs of rollers, one pair composed of rollers 20, and the other pair composed of rollers 21. Of each pair, one roller is a driving roller 20 and the other roller is a driven roller. The above-mentioned spacer functions as a guide member for guiding the card Ca nipped and being conveyed by the rollers 20 and rollers 21, at both sides (namely, obverse and reverse sides). The shafts of the rollers 20 and 21 (i.e., four shafts in total) are rotatably supported by the rotary frames 50. Two first gears (not shown) are mounted, respectively, on those ends of the shafts of the driving rollers of the rollers 20 and 21, which are close to the rotary frames 50. The first gears (not shown) mesh with two second gears (not shown), respectively, which have a larger diameter than the first gears. The shafts of the second gears are rotatably supported by the rear-side rotary frame 50.

The second gears mesh with a third gear (not shown) having a smaller diameter than the second gears. The first third gears are arranged inside (front side) the rear-side rotary frame 50, almost parallel to the front-side rotary frame 50. The axis of the third gear is positioned at the rotation centers O (see FIG. 4) of the rotary unit F. The shaft of the third gear penetrates the rear-side rotary frame 50, and is rotatably supported by the rear-side rotary frame 50. The shaft of the third gear is rotatably supported, at its front end, by a plate-shaped rear frame member (not shown) which is secured to the housing 2 and which extends outside (at the back) the rear-side rotary frame 50, almost vertical in parallel with the rear-side rotary frame 50.

A fourth gear (not shown) having a larger diameter than the third gear is mounted on the shaft of the third gear. The fourth gear is positioned between the rear-side rotary frame 50 and the rear-side frame member, closer the rear-side frame member. The fourth gear meshes with a fifth gear (not shown) mounted on the shaft of a first card-conveyance motor (i.e., stepping motor that can be driven in both the forward direction and the reverse direction, not shown). The fifth gear has a smaller diameter than the fourth gear, and is positioned between the rear-side rotary frame 50 and the rear-side frame member, closer the rear-side frame member. That is, the first card-conveyance motor is secured to the back of the rear-side frame member, the shaft of the first card-conveyance motor penetrates the rear-side frame member, and the fifth gear is mounted on the front end of the shaft of the first card-conveyance motor.

On the front-upper part of the rear-side frame member (namely, at the rotary frame 50 on the rear side), an unjamming dial (not shown) is provided. If the card Ca nipped between the rollers 20 and between the rollers 21 jams in the rotary unit F, disabling the rotary unit F from rotating, the operator may manually rotate the rollers 20 and rollers 21 to take out the card Ca (namely, to perform unjamming). A gear is mounted on the shaft of the unjamming dial. This gear rotates if the operator rotates the unjamming dial. The rotation of the gear is transmitted to the above-mentioned fourth gear by some gears provided on the rear-side frame member. The fourth gear is therefore rotated, and rotates the rollers 20 and 21. As a result, the card Ca is delivered from the rotary unit F.

The first card-conveyance motor functions as a driver for the cleaning rollers 22, too. That is, the fourth gear transmits the drive force of the first card-conveyance motor via gears to the gear mounted on the shaft of the cleaning rollers 22. Thus, the first card-conveyance motor drives the cleaning rollers 22, rollers 20 and rollers 21, not only conveying the card Ca from the medium supplying section C to the rotary unit F (thus, rotary unit F receives the card Ca, see FIG. 4), but also conveying the card Ca from the rotary unit F to the information recording section A, to the medium conveyance path P1 or to the rejected-sheet stacker 54.

(3-2) Rotation

The front-side rotary frame 50 is rotatably secured to a plate-like front-side frame member. The front-side frame member is secured to the housing 2, extends almost in vertical direction, in parallel to the front-side rotary frame 50 and is positioned in front of the front-side rotary frame 50. (the front-side frame member is not shown in FIG. 2 because the front-side rotary frame 50 is not shown, either.) More specifically, a support shaft extends from the back of the front-side frame member toward the front-side rotary frame 50, and a hollow cylindrical bearing is provided at the center part of the front of the front-side rotary frame 50, and supports the support shaft.

The axis of the support shaft is positioned at the rotation center O (see FIG. 4) of the rotary unit F, and is arranged coaxial with the third gear. Therefore, the rotary unit F can rotate because both rotary frames 50 are rotatably supported by the support shaft to the front-side frame member and the shaft of the third gear is rotatably supported by the rear-side frame member.

Two gears are formed on the circumferential surfaces of the rear-side rotary frame 50 and rear-side rotary frame 50, respectively. These gears mesh with two sixth gears having a smaller diameter, respectively. The sixth gears are mounted on one gear shaft arranged below the front-side rotary fame 50 and the rear-side rotary frame 50. The gear shaft of the sixth gears is rotatably supported by the front-side rotary frame and rear-side rotary frame.

The sixth gear meshing with the gear formed on the circumferential surface of the front-side rotary frame 50 meshes with a seventh gear (not shown) having a smaller diameter than the sixth gear and fitted on the shaft of a drive motor (i.e., stepping motor that can rotate in both the forward direction and the reverse direction, not shown). The drive motor is secured at the back of the rear-side frame member and located below the first card-conveyance motor described above. The shaft of the drive motor penetrates the rear-side frame member and has a seventh gear on its front end. Therefore, if the drive motor is driven, the card Ca held, at both edges, by the rollers 20 and 21 in the rotary unit F is rotated around the rotation center O of the rotary unit F (see FIG. 5).

When the drive motor rotates the rotary unit F, the shafts of the rollers 20 and the shafts of the rollers 21 rotate, too, because these shafts are rotatably supported by the rotary frames 50. (This phenomenon is called "simultaneous rotation.") In this embodiment, in order to rotate the card Ca nipped, at one end by the rollers 20 and at the other end by the rollers 21, the first card-conveyance motor is driven in the direction reverse to the direction the rotary unit F is has been rotated, by the same angle as the first card-conveyance motor has been driven. The simultaneous rotation is thereby prevented.

First and second cylindrical members are formed on the front-side rotary frame 50, and extend toward the front side. The first cylindrical member protrudes from the circumferential surface of the front-side rotary frame 50. The second cylindrical member is concentric with the first cylindrical member (with respect to the rotation center O), and protrudes forwards from that part of the front-side rotary frame 50, which has a smaller diameter than the first cylindrical member. The first and second cylindrical members have a notch each. First and second phase sensors (not shown) may detect the notches, to detect the phase of the rotary unit F (more precisely, rotary frames 50).

The notch of the first cylindrical member is cut in accordance with the position (or direction) of the notch cut in the second cylindrical member and with the directions of the sensors arranged around the rotary unit F. The notch of the second cylindrical member is cut in accordance with the positions of the rollers 20 and 21 (more precisely, the shafts of rollers 20 and 21). The first phase sensor functions as encoder for driving the drive motor that rotates the rotary unit F, and the second phase sensor functions as encoder for setting the rotary unit F (more precisely, the rollers 20 and 21) at the initial position.

(3-3) Positions of the Sensors

Sensors are arranged around the rotary unit F. As shown in FIG. 4, a sensor SN2 is arranged between the rollers 20 and the cleaning rollers 22, to detect the rear end of the card Ca being conveyed from the medium supplying section C. A sensor SN 26 is arranged downstream the rollers 21 in the card conveyance direction, to detect the front end of the card Ca being conveyed.

As described above, the magnetic recording unit 24, noncontact IC recording unit 23 and contact IC recording unit 27, which constitute the information recording section A, are arranged around the rotary unit F (see FIG. 2). As shown in FIG. 4, a sensor SN4 for detecting the ends of a card Ca and the above-mentioned sensor SN26 are arranged in the direction of the magnetic recording unit 24 and contact IC recording unit 27, respectively. Further, a sensor SN23 is arranged in the direction of the rejected-sheet stacker 54 (namely, in the direction of delivering erroneously fed cards), and a sensor SN3 is arranged in the direction of the printing section B (particularly, transfer unit B2, and on the horizontal medium conveyance path P1). Like the sensor SN24, the sensors SN3, SN4, SN5 and SN23 are one-piece transmissive sensors each having a light-emitting element and a light-receiving element.

In this embodiment, the line connecting the rotation center O to the sensing positions (i.e., dots in FIG. 4) of the sensors SN2 and SN24 is at angle of 10° to the vertical line (i.e., solid line shown in FIG. 4, namely reference line at angle 0°); the line connecting the rotation center O to the sensing position (i.e., dot in FIG. 4) of the sensor SN23 is at angle of 125° to the reference line; the line connecting the rotation center O to the sensing position of the sensor SN4 is at angle of 173° to the reference line; the line connecting the rotation center O to the sensing position of the sensor SN26 is at angle of 190° to the reference line; and the line connecting the rotation center O to the sensing position of the sensor SN3 is at angle of 270° to the reference line. The noncontact IC recording unit 23 and the sensor SN23 are arranged on a straight line passing the rotation center O.

Thus, the rotary unit F (rollers 20, rollers 21) has the function of forming a medium conveyance path 65 (see FIG. 2) for conveying the card Ca in one of these directions. That is, the rotary unit F has the function of changing the direction of conveying the card Ca. FIG. 4 illustrates the rotary unit F positioned to receive the card Ca. In this state, the rollers 20 and rollers 21 are positioned, together with the sensor SN24, cleaning rollers 22 and sensors SN2 and SN26 (both at sensing positions), in the medium conveyance path P0 substantially linear (inclined at 10° to the vertical line, i.e., solid line shown in FIG. 4). The medium conveyance path 65 makes a part of an inclined medium conveyance path P0. On the outer circumference of the rotary unit F, a temperature sensor Th (e.g., thermistor) is arranged to detect the ambient temperature, i.e., outside temperature (see FIG. 2). Based on the ambient temperature detected by the temperature sensor Th, the heating element of a thermal head (later described) and a heating roller (later described) provided in the printing section B are controlled.

(3-4) Distances Between the Rotation Center and Each Sensor

Figure 5:
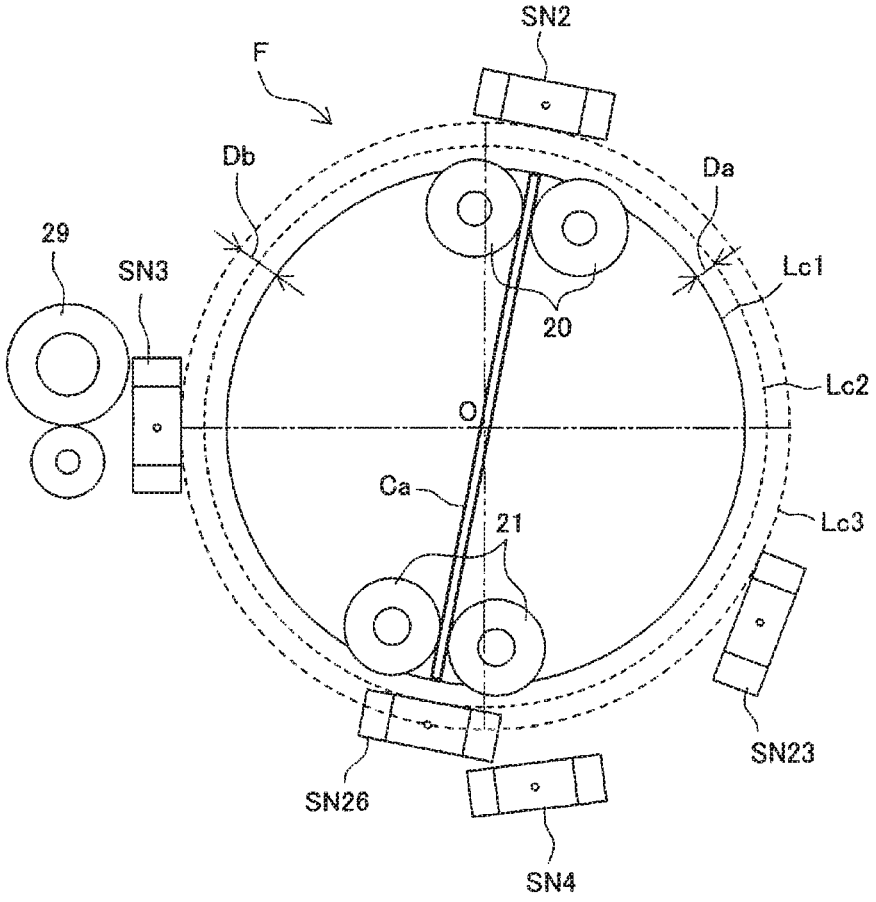
FIG. 5 is a diagram schematically showing the distances from the rotation center of the rotary unit to the sensors.

FIG. 5 schematically shows the distances from the rotation center O of the rotary unit to the sensors. To facilitate the understanding, FIG. 5 shows one standard-size card Ca normally conveyed to the rotary unit F, with its center part located at the rotation center O and with its one end nipped by the rollers 20 and its other end nipped by the rollers 21.

As described above, the card Ca of the standard size has a length of 85.6 mm. Therefore, the distance from the rotation center O to the first locus Lc1 (i.e., locus of the card end) is 42.8 mm, i.e., half the length of the card Ca; the distance Da between the first locus Lc1 and the second locus Lc2 (i.e., the circle around the rotation center O and contacting the frame of the sensor SN4) is 7.0 mm; the distance Db between the first locus Lc1 and the third locus Lc3 (i.e., the circle around the rotation center O and contacting the frames of the sensors SN2, SN3 and SN23) is 8.0 mm; and the distance between the first locus Lc1 and the sensor SN4 is 20.0 mm. The sensing positions of the sensors SN2, SN3 and SN26 are located still farther by 0.7 mm from the rotation center O.

Therefore, the linear distance on the inclined medium conveyance path P0 between the sensing position of the sensor SN2 for detecting the rear end of the card Ca and the sensing position of the sensor SN26 for detecting the front end of the card Ca is the length of card Ca (85.6 mm)+{distance Db (8 mm)+distance (0.7 mm) from the sensor frame of sensor SN2 to the sensing position thereof}+{distance Da (7.0 mm)+distance (0.7 mm) from the sensor frame of sensor SN26 to the sensing position thereof}=102 mm.

The sensing position of the sensor SN23 exists at the distance of 9.7 mm from the first locus Lc1, and the sensing position of the sensor SN4 exists at the distance 20.7 mm from the first locus Lc1 (or at the distance of 12.7 mm from the third locus Lc3). Hence, the sensor SN 26 is arranged closer to the rotation center O (i.e., rotary unit FIG.) than the sensors SN23, SN4 and SN3 (and sensor SN2).

(4) Printing Section B

The printing section B is configured to form portrait and character data on both sides of the card Ca. As shown in FIG. 2, it has a horizontal medium conveyance path P1 to convey the card Ca from the medium conveyance path 65. At the horizontal medium conveyance path P1, a pair of conveyance rollers 29 and a pair of conveyance rollers 30 are provided to convey the card Ca. The conveyance rollers 29 and 30 are connected by gears or the like (not shown) to a second card-conveyance motor (i.e., stepping motor that can rotate in both the forward direction and the reverse direction, not shown).

The printing section B has a film conveyance mechanism 10, and includes an image forming unit B1 and a transfer unit B2. In the image forming unit B1, a thermal head 40 uses an ink ribbon 41, forming images of different colors, one on another, in the image forming region of a transfer film 46 which is conveyed by way of the film conveyance mechanism 10. In the transfer unit B2, a heat roller 33 transfers the images from the transfer film 46 to one side of the card Ca on the horizontal medium conveyance path P1.

The printing section B will be described in detail with reference to FIG. 2. The transfer film 46 is shaped like a band having a width greater than the width of the card Ca. The transfer film 46 is composed of an ink-receiving layer for receiving ink from the ink ribbon 41, a transparent protection film for protecting the surface of the ink-receiving layer, a peel layer for peeling the ink-receiving layer and the protection film together when it is heated, and a base (i.e., base film). The ink-receiving layer, transparent protection film, peel layer and base are laid one on another in the order mentioned.

The transfer film 46 used in this embodiment has marks for setting an image-forming start position that are formed at regular intervals in the widthwise direction (i.e., main scanning direction of the thermal head 40) that intersects with the printing direction (i.e., sub-scanning direction of the thermal head 40). The spaces between these marks are image forming regions.

The transfer film 46 is fed from a supply roll 47 and taken up by a take-up roller 48, as motors Mr2 and Mr4 are driven in the transfer film cassette. In the transfer film cassette, the supply roll 47 and the take-up roller 48 are mounted on a supply spool 47A and a take-up spool 48A, respectively. The supply spool 47A receives the drive force of the motor Mr2 through a gear (not shown), and the take-up spool 48A receives the drive force of the motor Mr4 through a gear (not shown). The motor Mr2 and the motor Mr4 are DC motors that can rotate in both the forward direction and the reverse direction.

In this embodiment, the transfer film 46 is wound around the supply spool 47A, and the used transfer film 46 (i.e., that part of film 46, which has been used in the transfer unit B2) is wound around the take-up spool 48A. To form an image on the transfer film 46 and to transfer the image from the transfer film 46, the transfer film 46 is once fed from the supply spool 47A to the take-up spool 48A and is taken up around the supply spool 47A.

A film conveyance roller 49 is a main drive roller important for conveying the transfer film 46. The driving of the film conveyance roller 49 is controlled, determining the distance for which the transfer film 46 is conveyed and the position at which the transfer film 46 is stopped. The film conveyance roller 49 is connected to a film conveyance motor Mr5 (i.e., stepping motor) which can be driven in both the forward and the reverse direction. When the film conveyance roller 49 is driven, the motors Mr2 and Mr4 are driven, too, one feeding the transfer film and the other taking up the film, thereby applying a tension to the transfer film 46. Thus, the motors Mr2 and Mr4 perform an auxiliary function of conveying the transfer film.

At the circumferential surface of the film conveyance roller 49, pinch rollers 32*a* and 32*b* are arranged. The pinch rollers 32*a* and 32*b* can move toward and away from the film conveyance roller 49. As shown in FIG. 2, the pinch rollers 32*a* and 32*b* move to the film conveyance roller 49, holding a part of the transfer film 46 around the film conveyance roller 49. The transfer film 46 can therefore be correctly conveyed by the distance proportional to the number of times the film conveyance roller 49 rotates.

The film conveyance mechanism 10 thus conveys the transfer film 46 back and forth between the supply roll 47, image forming unit B1, transfer unit B2 and take-up roller 48, as the film conveyance roller 49 (i.e., main drive roller) arranged between the image forming unit B1 and the transfer unit B2 is rotated. The film conveyance mechanism 10 correctly positions the image-forming region of the transfer film 46 and the image formed in the image-forming region in the image forming unit B1 and transfer unit B2, thereby achieving so-called "cueing." A sensor Se1 having a light-emitting element and a light-receiving element and configured to detect the marks formed on the transfer film is arranged between the take-up roller 48 and the image forming unit B1 (having thermal head 40 and platen roller 45).

The ink ribbon 41 is stored in a ribbon cassette 42. In the ribbon cassette 42, the ink ribbon 41 is fed from a supply roll 43 to a take-up roll 44. The supply roll 43 is mounted on the a supply spool 43A, and the take-up roll 44 is mounted on the take-up spool 44A. The take-up spool 44A is rotated by a motor Mr1, and the supply spool 43A is rotated by a motor Mr3. The motor Mr1 and the motor Mr3 are DC motors that can rotate in both the forward direction and the reverse direction.

The ink ribbon 41 is composed of Y (yellow), M (magenta), C (cyan) and Bk (black) ribbon panels repeatedly arranged in the lengthwise direction. Between the supply roll 43 and the image forming unit B1 (having thermal head 40 and platen roller 45), a sensor Se2 is arranged. The sensor Se2 has a light-emitting element and a light-receiving element, and detects the position of the rink ribbon 41 when any Bk ribbon panel blocks the light beam emitted from the light-emitting element toward the light-receiving element, thereby cuing of the ink ribbon 41 in the image forming unit B1.

The platen roller 45 and the thermal head 40 constitute the image forming unit B1. The thermal head 40 is positioned, opposing the platen roller 45. To form an image, the platen roller 45 is pressed to the thermal head 40, with the transfer film 46 and rink ribbon 41 interposed between it and the thermal head 40. The thermal head 40 has a plurality of heating elements juxtaposed in the main scanning direction. The heating elements are selectively heated by a head control IC (not shown) in accordance with print data, and form an image on the transfer film 46 by using the ink ribbon 41. Note that a cooling fan 39 is used to cool the thermal head 40.

After the image is formed on the transfer film 46, a peeling roller 25 and a peeling member 28 peel the ink ribbon 41 from the transfer film 46. The peeling member 28 is secured to the ribbon cassette 42. The peeling roller 25 abuts on the peeling member 28 at the time of forming an image. The peeling roller 25 and the peeling member 28 clamp the transfer film 46 and the ink ribbon 41 together, peeling the ink ribbon 41 from the transfer film 46. The ink ribbon 41 so peeled is taken up around the take-up roll 44 driven by the motor Mr1. The transfer film 46 is conveyed by the film conveyance mechanism 10 to the transfer unit B2 having a platen roller 31 and a heat roller 33.

Downstream the film conveyance roller 49, a sensor Se3 is arranged to detect the marks formed on the transfer film 46. When the sensor Se3 detects the marks, the card Ca nipped by the conveyance rollers 29 and conveyance rollers 30 on the horizontal medium conveyance path P1 and thereby stopped (or kept waiting) is conveyed again toward the transfer unit B2. The card Ca and the image-forming region of the transfer film 46 therefore reach the transfer unit B2 at the same time. Note that the sensor Se3 is a one-piece transmissive sensor having a light-emitting element and a light-receiving element.

In the transfer unit B2, the transfer film 46 is clamped, together with the card Ca, between the heat roller 33 and the platen roller 31. Therefore, the image is transferred from the image-forming region of the transfer film 46 to one side of the card Ca. That is, the heat roller 33 is pressed to the platen roller 31, with the card Ca and the transfer film 46 (i.e., image-forming region) clamped between it and the platen roller 31, and the card Ca and the transfer film 46 are conveyed at the same speed and in the same direction. The heat roller 33 is secured to a lift mechanism (not shown), and can contact and leave the platen roller 31 with the transfer film 46 lying between it and the platen roller 31.

The transfer film 46 from which the image has been transferred is separated (or peeled) from the card Ca by a peeling pin 79 arranged between the heat roller 33 and a driven roller (i.e., downstream roller, see FIG. 2), which constitute a conveyance roller pair 37. The transfer film 46 is then conveyed to the supply roll 47. Meanwhile, the card Ca, to which the image has been transferred, is conveyed in a horizontal conveyance path P2 toward the de-curling mechanism G positioned downstream.

As described above, the ink ribbon 41 is designed for color printing, composed of Y, M, C and Bk ribbon panels repeatedly arranged. Instead, only a monochrome ink ribbon composed of Bk ribbon panels can be used in the printing apparatus 1 according to the embodiment. If the monochrome ink ribbon is used, a monochrome image will be printed on the card Ca.

(5) De-Curling Mechanism G

As shown in FIG. 2, a horizontal medium conveyance path P2 is provided downstream the transfer unit B2 and extends from the horizontal medium conveyance path P1 to convey the card Ca (already printed) to a stacker 60. At the medium conveyance path P2, a pair of conveyance rollers 37 and a pair of conveyance rollers 38 are arranged to convey the card Ca. The conveyance roller pairs 37 and 38 are connected to the second card-conveyance motors described above via gears or the like (not shown). The roller pairs 29, 30, 37 and 38 (and the platen roller 31) arranged in the horizontal medium conveyance paths P1 and P2 are rotated by the second card conveyance motors.

The conveyance rollers 37 and the conveyance rollers 38 constitute a part of the de-curling mechanism G. The de-curling mechanism G has a de-curling unit 34. The de-curling unit 34 is shaped convex and pushes down the center part of the card Ca nipped at both ends by the conveyance rollers 37 and the conveyance rollers 38, thereby clamping the card Ca and straightening up the card Ca curled due to the heat the heat roller 33 has applied to it during the thermal transfer. The de-curling mechanism G includes an eccentric cam 36, which can move the de-curling unit 34 up and down as shown in FIG. 2.

(6) Medium Storing Section D

The medium storing section D has a stacker 60 configured to store the card Ca conveyed from the de-curling mechanism G. The stacker 60 can be moved down by a lift mechanism 61 as may be seen from FIG. 2.

1-2-2 Control Section and Power Supply Section

The printing apparatus 1 includes a control section and a power supply section, which will now be described. As shown in FIG. 6, the printing apparatus 1 has a control section 70 and a power supply section 80. The control section 70 controls all operations in the printing apparatus 1. The power supply section 80 converts the commercially available AC power to DC power that can drive/operate the mechanical units and the control units of the printing apparatus 1.

(1) Control Section

As shown in FIG. 6, the control section 70 has a microcomputer unit 72 (hereinafter abbreviated as "MCU 72") for controlling over the printing apparatus 1. The MCU 72 is composed of a CPU that operates as central processing unit at high clock speed, a ROM storing the programs and program data that for the printing apparatus 1, a RAM operating as work area of the CPU, and an internal bus connecting the CPU, ROM and RAM.

An external bus is connected to the MCU 72. A communications unit 71 and a memory 77 are connected to the external bus. The communications unit 71 has a communications IC and communicates with the host apparatus 101. The memory 77 temporarily stores the print data for forming an image on the card Ca and the record data that should be magnetically or electrically recorded in the magnetic stripe or internal IC of the card Ca.

To the external bus, a signal processing unit 73, an actuator control unit 74, a thermal head control unit 75, an operation display control unit 76, a buzzer operating circuit 78, and the above-mentioned information recording section A are connected. The signal processing unit 73 processes signals coming from the various sensors described above. The actuator control unit 74 includes a motor driver configured to drive pulses and drive power to the motors. The thermal head control unit 75 controls the thermal energy supplied to the heating elements constituting the thermal head 40. The operation display control unit 76 controls the operation panel unit 5. The buzzer operating circuit 78 operates a buzzer 6 if cards Ca are multi-fed, one overlapping another.

(2) Power Supply Section

The power supply section 80 supplies operation/drive power to the control section 70, thermal head 40, heat roller 33, operation panel unit 5, information recording section A and the like.

2. Operation

Hereinafter, it will be explained how the printing apparatus 1 according to this embodiment operates, mainly how the CPU of the MCU 72 (hereinafter called "CPU") operates.

When power is supplied to the printing apparatus 1, each component of the printing apparatus 1 is set at home (initial) position (as shown in, for example, FIG. 2), and the programs and program data stored in the ROM are initialized in the RAM.

Figure 7:
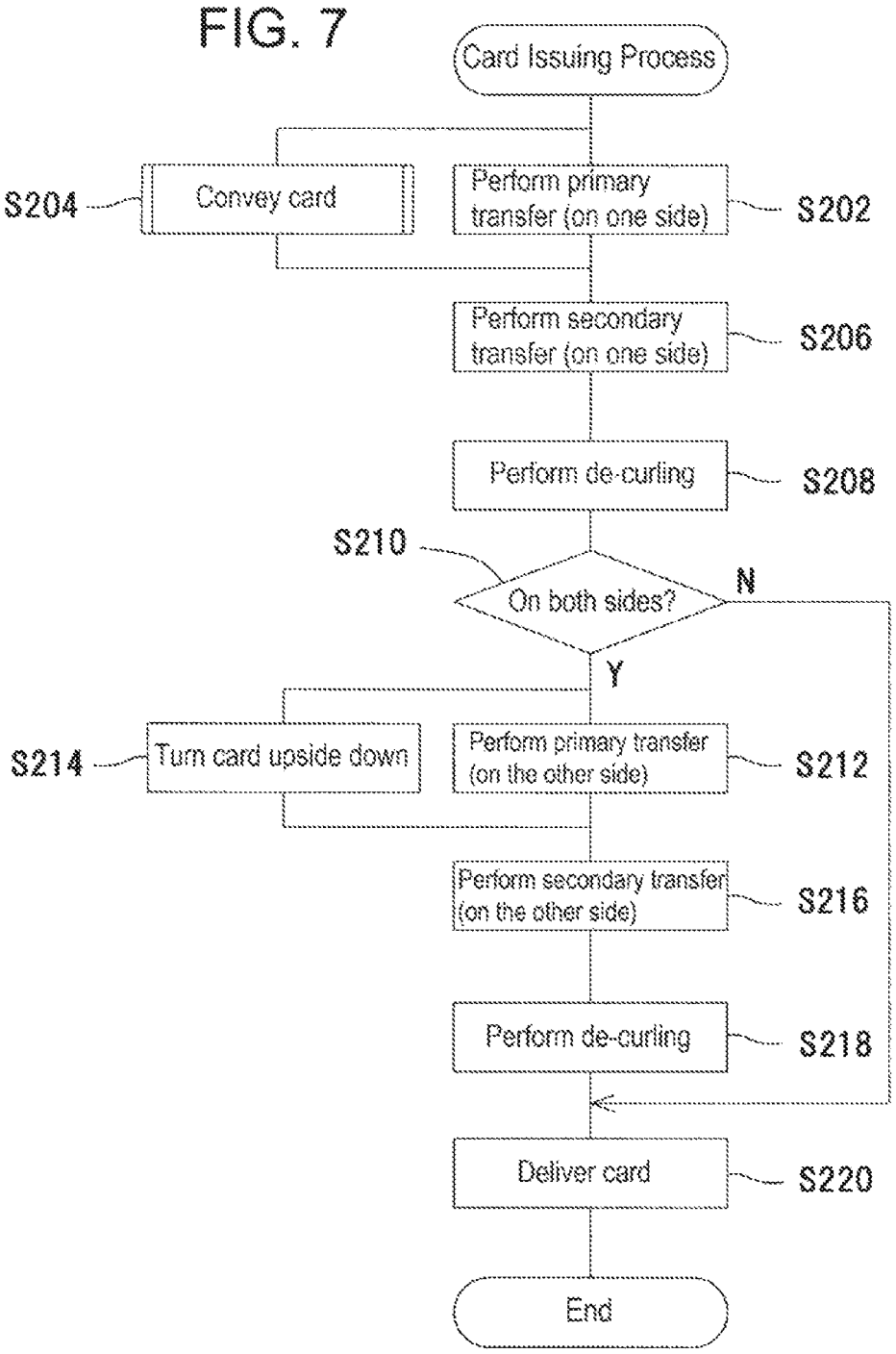
FIG. 7 is a flowchart of the card issuing routine performed by the CPU of the microcomputer unit of the control section provided in the printing apparatus.

When the CPU receives the print instructions from the operation panel unit 5 (more precisely, operation display control unit 76) or through the communications unit 71, it executes the card issuing routine shown in FIG. 7. To simplify the explanation, it is assumed that the CPU has received, from the host apparatus 101, the print data (composed of Bk print data and Y, M and C color-component print data, for one-side or double-side printing), the data designating the storage area for storing the print data, and electric and magnetic record data, and that the CPU has stored these data into the memory 77. The operations of the printing section B (i.e., image forming unit B1 and transfer unit B2) have been explained above, and will be briefly described below to avoid repetitive explanations.

2-1. Printing on One Side of the Card

As shown in FIG. 7, in step S202 of the card issuing routine, the image forming unit B1 performs a primary transfer process (i.e., image forming process) of forming an image (mirror image) on the transfer film 46 for one side (e.g., obverse side) of a card. That is, the thermal head 40 of the image forming unit B1 is controlled in accordance with the Y, M and C print data and the Bk print data stored in the memory 77. A Y ink image, an M ink image, a C ink image and a Bk ink image are thereby formed, one overlapping another, in the image forming region of the transfer film 46.

As the primary transfer is performed in Step S202, the CPU performs the card supplying process in Step S204. The card supplying process includes (1) a card supplying process of feeding the card Ca from the medium supplying section C and conveying the card Ca to the information recording section A, (2) a process of recording electric or magnetic record data on a card Ca or cards Ca in the information recording section A, and (3) a second card conveying process of conveying a card Ca, record-processed or not record-processed, toward the horizontal medium conveyance path P1 (having conveyance rollers 29 and conveyance rollers 30).

(1) Card Supplying Process (1-1) Driving Toward Card Receiving Position

Figure 8:
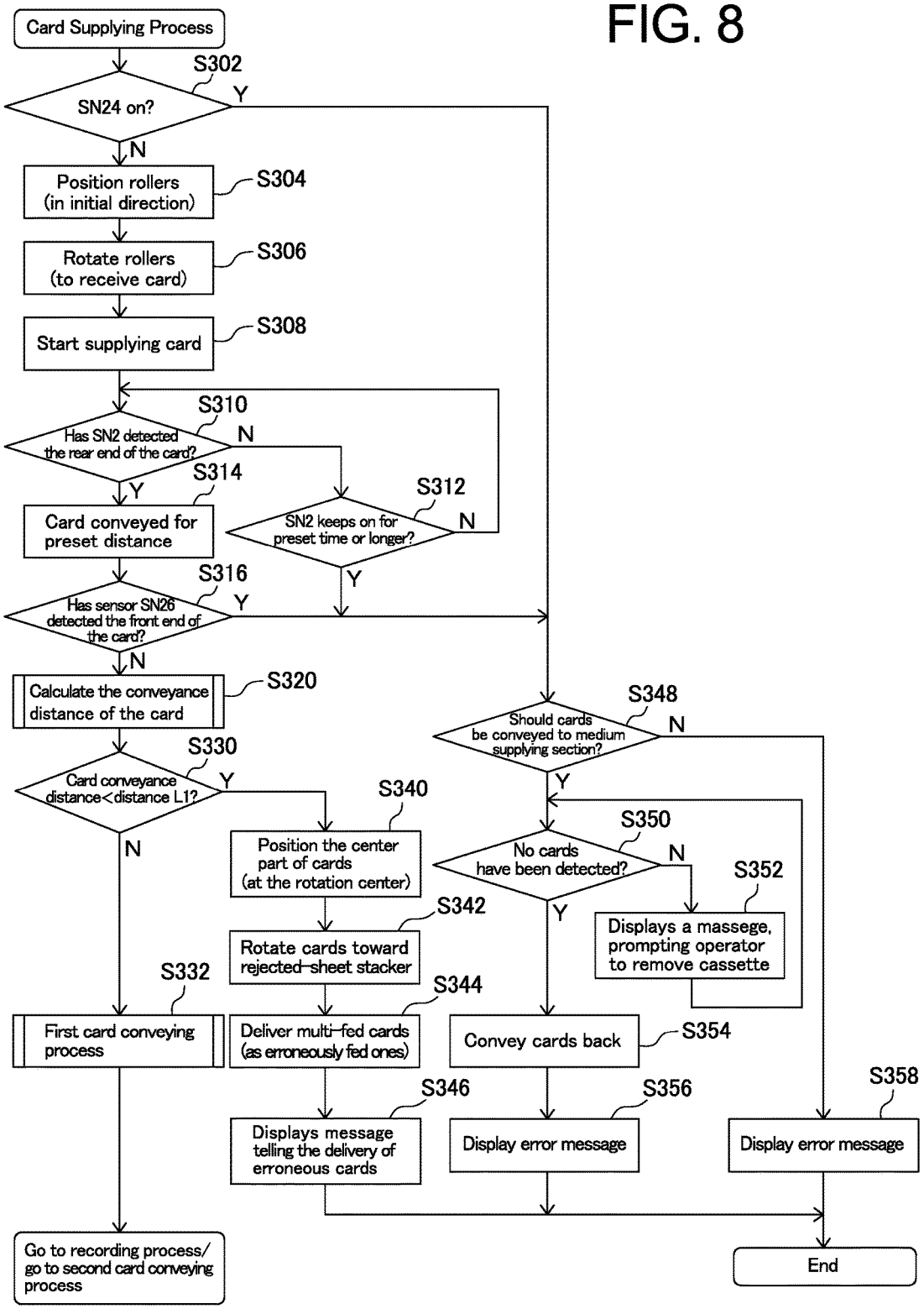
FIG. 8 is a flowchart showing a card supplying subroutine that is a part of the card supplying process of the card issuing routine.

FIG. 8 is a flowchart illustrating the card supplying subroutine. In the card supplying subroutine, it is determined in Step S302 whether the sensor SN24 is on (enabled to detect a card). As shown in FIG. 4, in the medium supplying section C, cards Ca are stored and aligned in standing position. An unskilled operator may push, from above, the foremost card Ca in the medium supplying section C. If the sensor SN24 is on in this case or in any other case, something is considered existing in the sensor SN24.

If Yes in Step S302, the process jumps to Step S348. If No in Step S202, the process goes to Step S304. In Step S304, the actuator control unit 74 drives the drive motor in accordance with the output of the second phase sensor (described above), thereby positioning the rollers 20 and rollers 21 constituting the rotary unit F, in the initial positioning direction. In this embodiment, the rollers 20 and the rollers 21 extend in the horizontal direction (namely, in the state shown in FIG. 2) while they remain in the initial positioning direction.

Next, in Step S306, the drive motor is driven, positioning the rollers 20 and rollers 21, which constitute the rotary unit F, in a card-receiving direction. The card-receiving direction is set at 10° around the rotation center O, from the vertical line (i.e., solid line) shown in FIG. 4. Hence, in Step S306, the rollers 20 and rollers 21 at their initial position direction in Step 304, namely at 90° from the vertical line shown in FIG. 4, are rotated by 80° in the counterclockwise direction (CCW).

(1-2) Feeding of the Card

In the next step S308, the actuator control unit 74 drives a pickup motor and a first card-conveyance motor. As the pickup motor 19 is driven, the front-most card Ca in the medium supplying section C is fed from the medium supplying section C and conveyed toward the rotary unit F via the cleaning rollers 22 as the pickup roller 19 is being rotated. The pickup motor stops rotating after the sensor SN24 detects the rear end of the card Ca. However, the first card-conveyance motor is kept driven (and keeps rotating the cleaning rollers 22, rollers 20 and rollers 21) even after the pickup motor stops rotating in order to convey the card Ca to the rotary unit F.

Then, in Step S310, it is determined whether the sensor SN2 arranged on the inclined medium conveyance path P0 has detected the rear end of the card Ca being conveyed. If No, it is determined, in Step S312, whether the sensor SN2 keeps on for a preset period of time or longer after the sensor SN2 detects the front end of the card Ca (namely, whether the card Ca has been conveyed longer than a preset distance). This can be determined, for example, first by counting the drive pulses output from the actuator control unit 74 to the first card-conveyance motor from the time when the sensor SN2 detects the front end of the card Ca, and then by determining whether the number of drive pulses counted has reached a prescribed value.

In this embodiment, if the number of drive pulses required to convey the card Ca for 113.6 mm (=85.6 mm (standard length of card Ca)+28.0 mm (threshold value for conveying of multi-fed cards) is counted from the time when the sensor SN2 detects the front end of the card Ca, the CPU determines in Step S312 that two or more cards Ca have been multi-fed (namely, Yes in Step S312). In this case, the process goes to Step S348. If No in Step S312, the process then returns to Step S310 to continue the conveyance of the card Ca.

(1-3) Rotary Unit F Rotable

If Yes in Step S310, the process goes to Step S314. In Step S314, the card Ca is conveyed for a preset distance Dp1 from the time when the sensor SN2 detected the rear end of the card Ca, and the first card-conveyance motor is stopped. In this embodiment, the preset distance Dp1 is 8.7 mm. Therefore, if the card Ca is normally conveyed, it will be stopped with its center part positioned at the rotation center O of the rotary unit F and with its ends nipped by the rollers 20 and rollers 21 (as shown in FIG. 5). The preset distance Dp1 need not be 8.7 mm, and can have any other value so long as the rear end of the card Ca extends more than 0.7 mm from the frame of the sensor SN2. The reason why the distance Dp1 is set to 8.7 mm will be described later, in connection with Step S320.

Figure 13A:
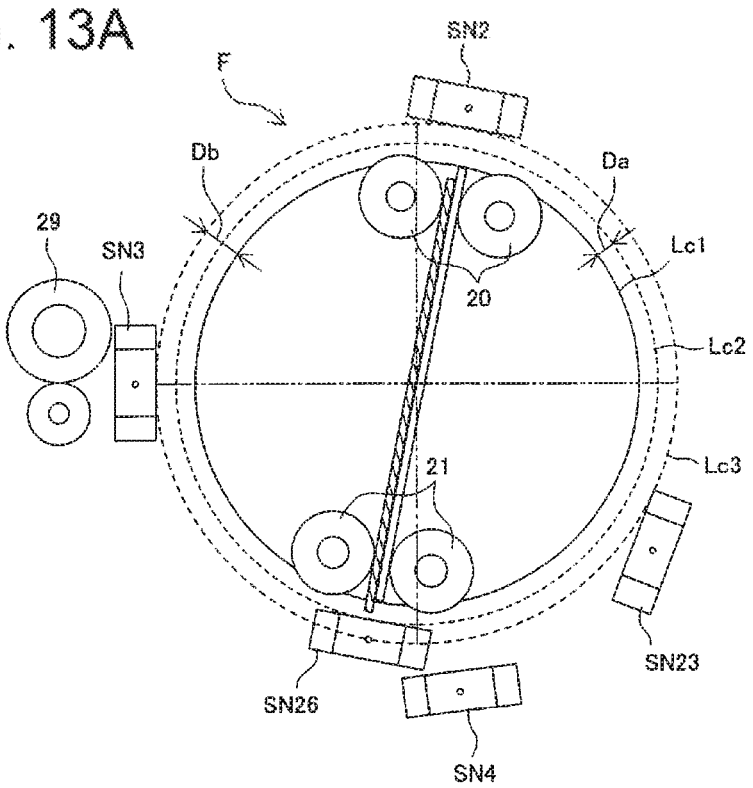
FIGS. 13A and 13B are diagrams schematically showing whether the rotary unit can be rotated or not.
Figure 13B:
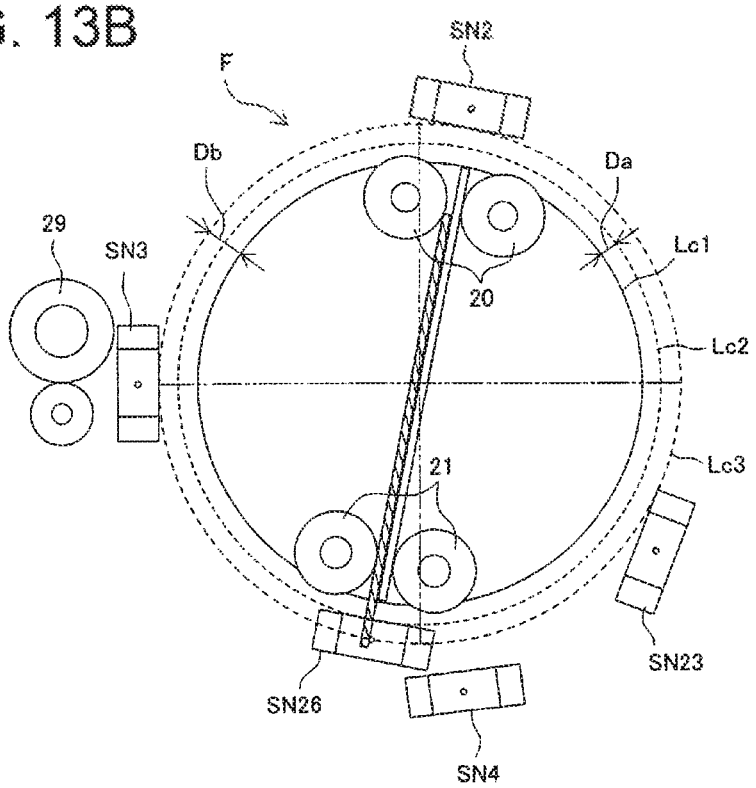

Then, in Step S316, it is determined whether the sensor SN26 arranged above the inclined medium conveyance path P0 has detected the front end of the card Ca. As shown in FIG. 13B, the distance between the front ends of the two cards multi-fed and the rear ends thereof is longer than the standard length of one card Ca. The distal ends of the cards therefore reach the sensor SN26 earlier than in the case where one card Ca correctly conveyed. If the rotary unit F is rotated in the state shown in FIG. 13B, the front ends of the multi-fed cards interfere with the frame of the sensor SN26. Even if cards are multi-fed as shown in 13A, their front ends do not interfere with the frame of the sensor SN26 unless the sensor S26 detects the front ends of the multi-fed cards. Thus, in accordance with whether the sensor SN26 detects the front end of the card Ca, it can be determined whether or not the front ends of the cards (i.e., multi-fed cards) interfere with the frame of the sensor SN26 at the time when the rotary unit F is rotated.

(1-4) Determining Multi-Feeding

Figure 9:
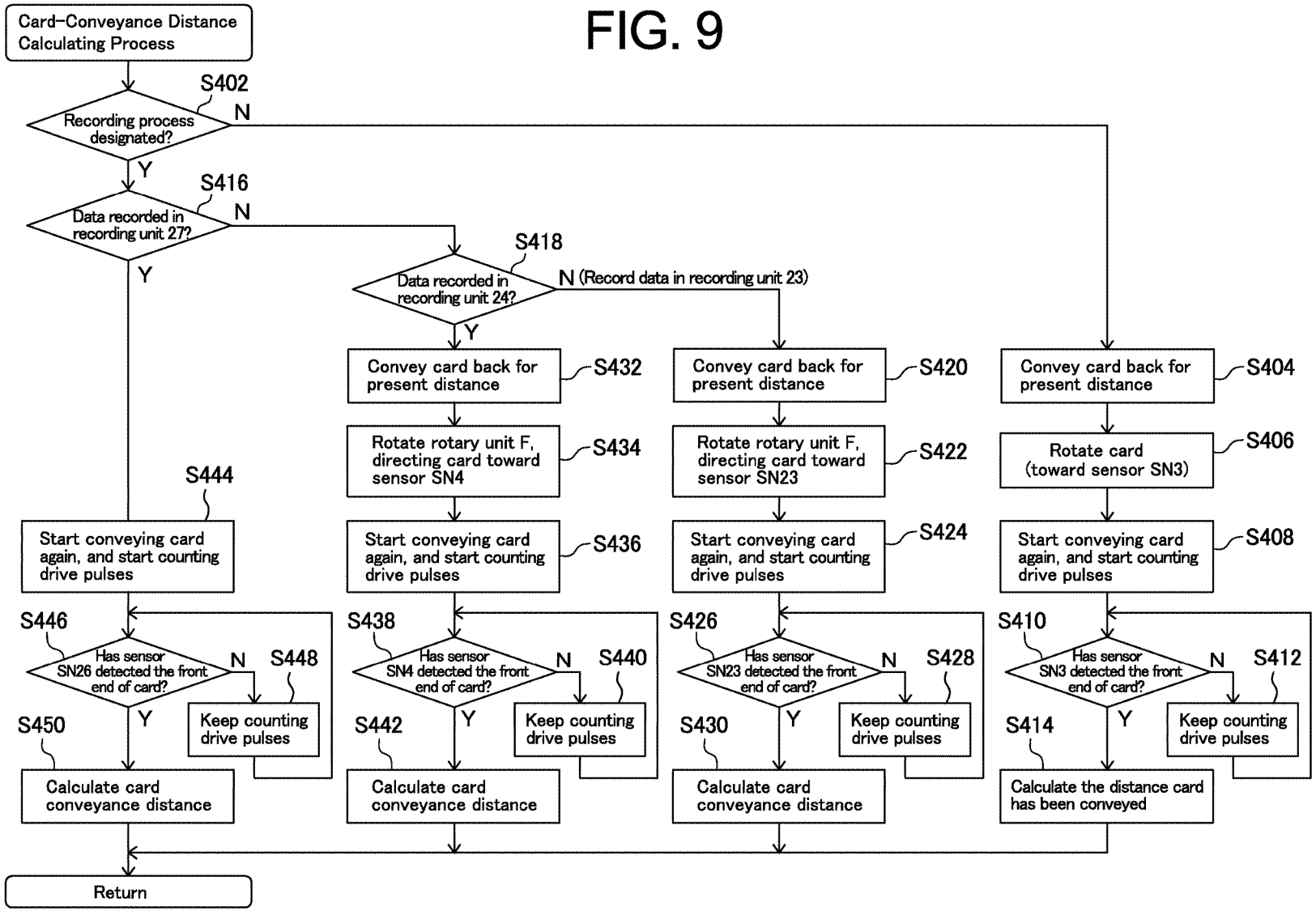
FIG. 9 is a flowchart of the subroutine of the card-conveyance distance calculating process subroutine, showing the detail of the card-conveyance distance calculating process of the card supplying subroutine.

If Yes in Step S316 (if the front end of the card is detected), the process goes to Step S348. If No in Step S316 (if the front end of the card is not detected), the process goes to Step S320, in which the distance the card has been conveyed is calculated. FIG. 9 is a flowchart of the subroutine of the card-conveyance distance calculating process, showing, in detail, how to calculate the distance the card has been conveyed in Step S320.

Figure 11A:
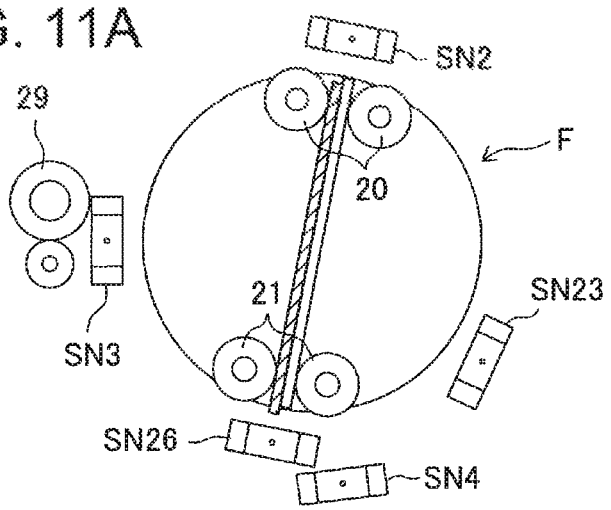
FIGS. 11A to 11C are diagrams schematically explaining how multi-fed cards are conveyed together to the rotary unit.

As shown in FIG. 9, in the subroutine of the card-conveyance distance calculating process, it is first determined in Step S402 whether the recording process in the information recording section A is designated or not. If No, the process goes to Step S404. In Step S404, the first card-conveyance motor is driven in the reverse direction, conveying the card Ca back toward the rotary unit F for a preset distance Dp2 (i.e., 0.7 mm in this embodiment), and the first card-conveyance motor is stopped (see FIG. 11A). The card Ca is conveyed back for the preset distance Dp2, because the sensor frame of the sensor SN26, which is a one-piece transmissive sensor, may interfere with the front end of the card if the rotary unit F holding the card Ca is rotated in the case where the distal end of the card has reached the frame of the sensor S26 but has not reached the sensing position of the sensor SN26. If the sensor SN26 is, for example, a one-piece reflective sensor, its frame would not interfere with the front end of the card, and Step S404 need not be performed.

Figure 11B:
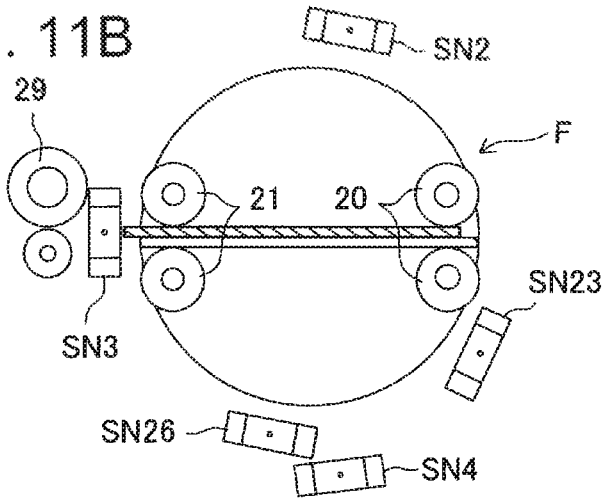

In next Step S406, the rotary unit F is rotated (in clockwise by 80°, see FIG. 11B), directing the card Ca nipped by the rollers 20 and rollers 21 to the sensor SN3 arranged in the horizontal medium conveyance path P1 (namely, changing the card conveyance direction to convey the card Ca toward the horizontal medium conveyance path P1). The distance Dp1 is set to 8.7 mm in Step S314 as shown in FIG. 8. This is because both ends of the card Ca should better be nipped by the rollers 20 and rollers 21 in order to prevent the aforementioned simultaneous rotation when the rotary unit F is rotated, and also because after the rotary unit F is rotated, the time required to convey the font end of the card to the rollers 20 should be almost equal to the time required to convey the font end of the card to the rollers 21.

In Step S408, the first card-conveyance motor is driven, starting (or resuming) the conveyance of the card Ca to a sensor SN3, and starting the counting of the pulses output from the actuator control unit 74 to the first card-conveyance motor.

Figure 11C:
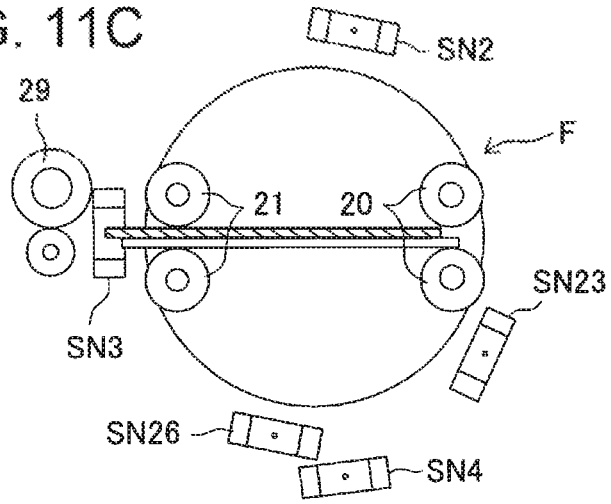

In next Step S410, it is determined whether the sensor SN3 has detected the front end of the card Ca. If No, the drive pulses output from the actuator control unit 74 to the first card-conveyance motor are counted in Step S412, and the process returns to Step S410. If Yes in Step S410, the process goes to Step S414. In Step S414, the first card-conveyance motor is stopped, and the counting of drive pulses is stopped, and the distance Ld the card has been conveyed is calculated. Then, the subroutine of the card-conveyance distance calculating process is terminated. FIG. 11C shows the state in which the sensor SN3 detects the front ends of the multi-fed cards.

Figure 15:
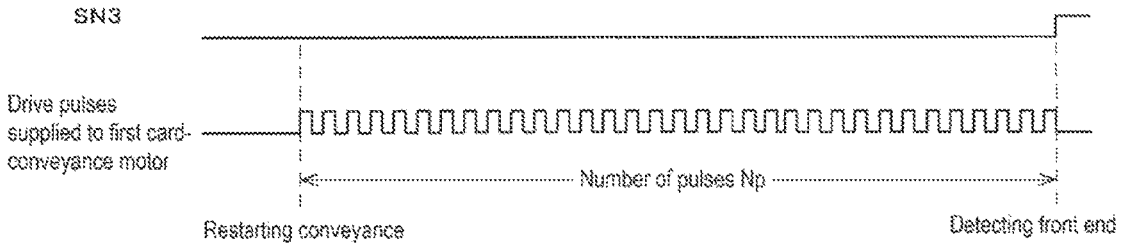
FIG. 15 is a timing chart illustrating the relation between the output of the sensor for detecting the front end of a card in a horizontal medium conveyance path and the drive pulses for driving the first card-conveyance motor.

FIG. 15 is a timing chart illustrating the relation between the output of the sensor SN3 for detecting the front end of the card Ca in the horizontal medium conveyance path P1 and the drive pulses output from the actuator control unit 74 to the first card-conveyance motor. The number of drive pluses counted in Step S414 reaches value Np (see FIG. 15). The first card-conveyance motor is a stepping motor (i.e., pulse motor) and conveys the card Ca for a predetermined distance in response to one pulse. Hence, the distance Ld the card is conveyed can be determined from the number of pulses Np supplied to the first card-conveyance motor.

Since the card Ca is conveyed back for the preset distance Dp2 (i.e., 0.7 mm) in Step S404, if the card Ca of standard size is normally conveyed (not multi-fed, together with any other card), it is conveyed for distance of 9.4 mm (={distanced Db (8 mm)+preset distance Dp2 (0.7 mm)+distance (0.7 mm) from the frame of the sensor SN3 to the sensing position thereof} between the time when the conveyance of the card Ca is started in Step S408 and the time when the sensor SN3 detects the front end of the card in Step S410 (see FIG. 5, too).

As shown in FIG. 11C, two cards may be multi-fed. In this case, the distance between the front end of the preceding card and the rear end of the following card is longer than the length of a standard-size card Ca. The front end of the preceding card therefore reaches the sensor SN3 earlier than the front end of a card Ca normally conveyed. The distance Ld the multi-fed cards are conveyed from the time when the conveyance of the card Ca is started in Step S408 to the time when the sensor SN3 detects the front end of the following card in Step S410 therefore becomes shorter. Hence, if a reference number of pulses (i.e., pulses that must be supplied to the first card-conveyance motor to move a card Ca for a distance of 9.4 mm) is preset as shown in FIG. 15, the distance Ld the multi-fed cards are conveyed can be determined from the number by which the pulses actually supplied are fewer than the reference number.

If Yes in Step S402 (if the recording process in the information recording section A is designated), the process goes to Step S416. In Step S416, it is determined whether the information recording section A has a contact IC recording unit 27. If No in Step S416, the process goes to Step S418, in which it is determined whether the information recording section A has a magnetic recording unit 24. If No in Step S418 (if information should be recorded by the noncontact IC recording unit 23), a process generally similar to the process performed in Steps S404 to S414 described above is performed in Steps S420 to S430, and the subroutine of card-conveyance distance calculating process is terminated.

The process of Steps S420 to S430 differs from the process of Steps S404 to 414 in the following three respects. (a) In Step S406, the rotary unit F is rotated, directing the card Ca toward the sensor SN3, and in Step S422, the rotary unit F is rotated (counterclockwise by 65°), directing the card Ca toward the sensor SN23. (b) In Step S410, it is determined whether the sensor SN3 has detected the front end of the card Ca being fed, and in Step S426, it is determined whether the sensor SN23 has detected the front end of the card Ca being fed. (c) If a card Ca having the standard length is normally conveyed, the card Ca is conveyed for 9.4 mm from the time when its conveyance is started in Step S408 to the time when the sensor SN3 detects the front end of the card in Step S410, and the card Ca is conveyed for 10.4 mm (=9.7 mm (distance between the first locus Lc1 and the sensing position of the sensor SN23)+0.7 mm (preset distance Dp2)), from the time when the conveyance of the card Ca is started in Step S424 to the time when the sensor SN23 detects the front end of the card Ca in Step S426.

If Yes in Step S418 (if the recording process in the magnetic recording unit 24 is designated), a process similar to Steps S404 to S414 is generally performed in Steps S432 to S442, and the subroutine of the card-conveyance distance calculating process is terminated. The process of Steps S432 to S442 differs from the process of Steps S404 to S414 in the following three respects. (a) In Step S406, the rotary unit F is rotated to direct the card Ca toward the sensor SN3, and in Step S434, the rotary unit F is rotated (by 17° in the counterclockwise) to direct the card Ca toward the sensor SN4. (b) In Step S410, it is determined whether the sensor SN3 has detected the front end of the card Ca being conveyed, and in Step S438, it is determined whether the sensor SN4 has detected the front end of the card Ca being conveyed. (c) If a card Ca having the standard length is normally conveyed, it is conveyed for 9.4 mm from the time of Step S408 to the time of Step S410 (determined YES) and it is conveyed for 21.4 mm (=20.7 m (distance between the first loci Lc1 and the sensing position of the sensor SN4)+0.7 mm (preset distance Dp2) from the time when the conveyance of the card Ca starts in Step S436 to the time when the sensor SN4 detects the front end of the card in Step S438.

If Yes in Step S416 (if the recording process in the contact IC recording unit 27 is designated), the process similar to Steps S404 to S414 is generally performed in Steps S444 to S450, and the subroutine of the card-conveyance distance calculating process is then terminated. The process of Steps S444 to S450 differs from the process of Steps 404 to S414 in the following three respects. (a) The rotary unit F need not be rotated because the contact IC recording unit 27 is arranged in a line extending from the inclined medium conveyance path P0, and process equivalent to Steps S404 and S406 need not be performed. (b) In Step S410, it is determined whether the sensor SN3 has detected the front end of the card Ca being conveyed, and in Step S446, it is determined whether the sensor SN26 has detected the front end of the card Ca being conveyed. (c) A card Ca having the standard length is normally conveyed 9.4 mm from the time of Step S408 to the time of Step S410 (determined YES) if it is conveyed, and is conveyed 8.7 mm (i.e., distance between the first locus Lc1 and the sensing position of the sensor SN26) from the time when the card conveyance is started in Step S444 to the time when the sensor SN26 detects the front end of the card.

As shown in FIG. 8, in Step S330 it is determined whether the distance Ld the card has been conveyed is shorter than a preset distance L1. The distance L1 is preset in accordance with the distance the card Ca having the standard length is conveyed normally. The distance L1 is 9.4 mm if the sensor SN3 detects the front end of the card (in Step S410), is 10.4 mm if the sensor SN23 detects the front end of the card (in Step S426), is 21.4 mm if the sensor SN4 detects the front end of the card (in Step S438), is 8.7 mm if the sensor SN26 detects the front end of the card (in Step S446). That is, if the distance Ld is longer than the distance L1, it is determined that the card has been conveyed, not multi-fed together with any other card. An allowance may be added to the distance L1 in consideration of the card expansion and contraction due to the installation error of each sensor or the change in the ambient temperature.

In Step S330, whether the distance Ld the card has been conveyed is shorter than 9.4 mm is determined if the sensor SN3 detects the front end of the card, because the rollers 20 and rollers 21 may slip with respect to the card Ca. This may be determined by using the upper limit (11.4 mm) of the allowance for the distance L1 if the sensor SN3 also detects the front end of the card. In this case, the card supplying subroutine need not be terminated because of an error. For example, a message may instead be displayed on the operation panel unit 5 to prompt the operator to clean the rollers 20 and rollers 21 that convey the card.

In Steps S414, S430, S442 and S450 shown in FIG. 9, the CPU need not calculate the distance Ld the card has been conveyed. (The distance Ld is used in these steps, as in Step S330, to facilitate the understanding.) If the data representing the reference number of pulses described above and the distance the card is conveyed by using one pulse is stored in the ROM, the decision can be made in Step S330, directly from the number of pulses Np shown in FIG. 15.

Figure 10:
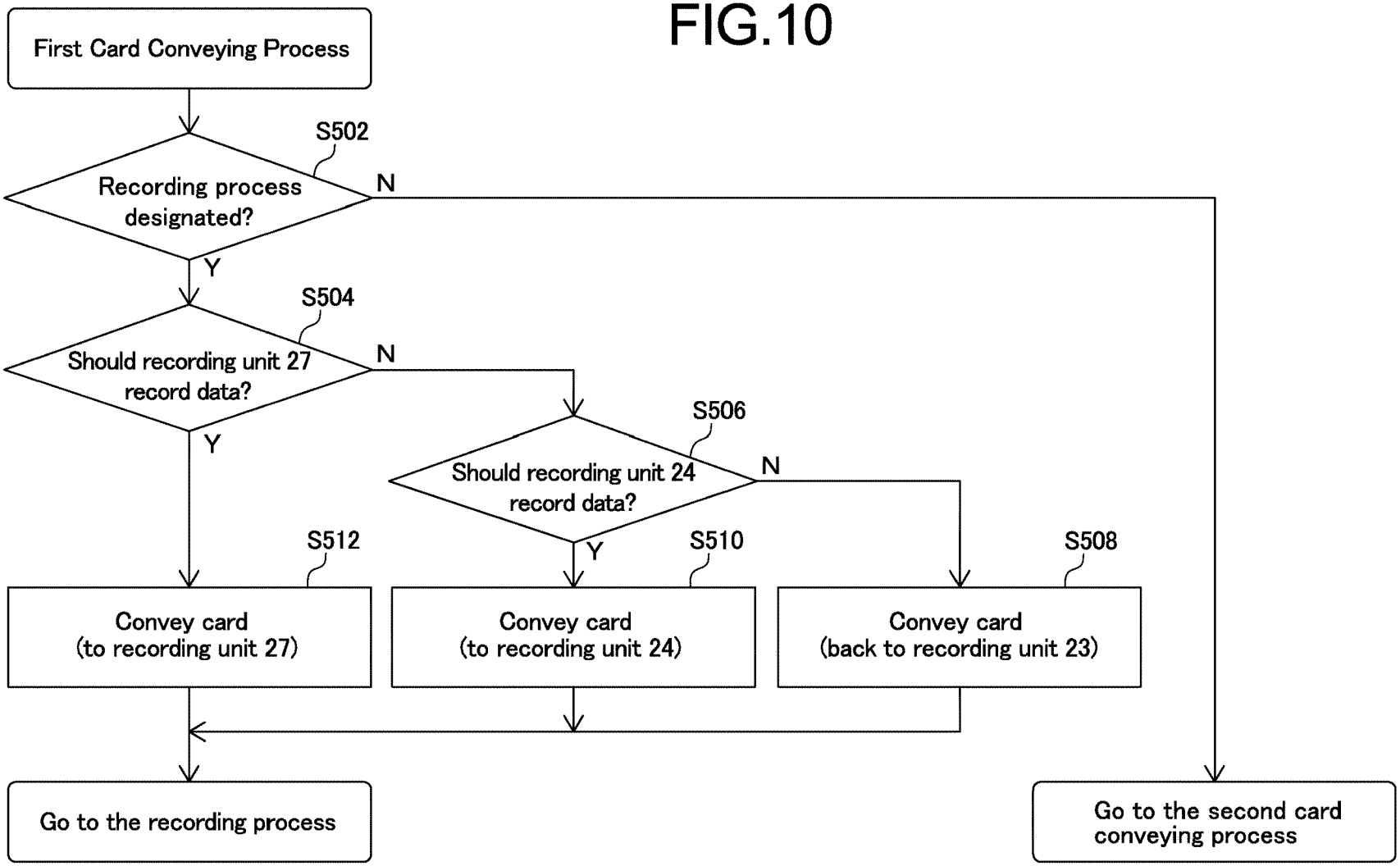
FIG. 10 is a flowchart of the first card conveying subroutine, showing, in detail, the first card conveying process of the card supplying subroutine.

If No in Step S330, the first card conveying process is performed to convey the card Ca mainly to the information recording section A in Step S332. FIG. 10 is a flowchart of the first card conveying subroutine, showing, in detail, the first card conveying process (performed in Step S332).

As shown in FIG. 10, the first card conveying subroutine and the card supplying subroutine are terminated if the recording process in the information recording section A is not designated (if No in Step S502). Then, the second card conveying process is performed.

If the recording process is designated in the noncontact IC recording unit 23 (if No in Step S504 and Step S506), the process goes to Step S508. In Step S508, the first card conveyance motor is driven in the reverse direction, conveying the card Ca to the noncontact IC recording unit 23 (see FIG. 16B). Then, the first card conveying subroutine and the card supplying subroutine are terminated, and the recording process is started. If the recording process in the magnetic recording unit 24 is designated (if No in Step S504 and Yes in Step S506), the first card conveyance motor is driven (in the forward direction) in Step S510, conveying the card Ca to the magnetic recording unit 24. The first card conveying subroutine and the card supplying subroutine are then terminated, and the recording process is started. If the recording process in the contact IC recording unit 27 is designated (if Yes in Step S504), the process goes to Step S512. In Step S512, the first card-conveyance motor is driven (in the forward direction), conveying the card Ca to the contact IC recording unit 27. Then, the first card conveying subroutine and the card supplying subroutine are terminated, and the recording process is started.

(1-5) Delivery of Multi-Fed Cards

If Yes in Step S330, it is determined that two or more cards have been multi-fed (or a card of a size other than the standard size has been mixed with a card of the standard size). In this case, a process is performed to reduce the operator's unjamming labor (namely, to enhance the unjamming efficiency). (This process is also performed if Yes in Steps S302, S312 and S316.) In this embodiment, the direction of erroneous card feeding (i.e., multi-feeding) is the direction to the rejected-sheet stacker 54 (namely, the direction of the line connecting the rotation center O and the sensing position of the sensor SN23).

Figure 12A:
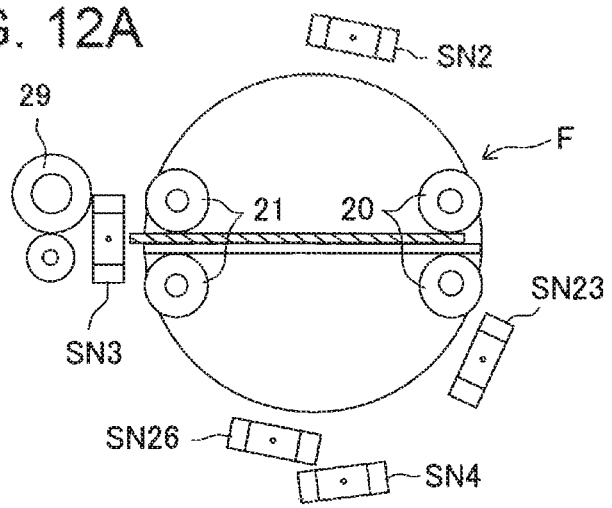
FIGS. 12A to 12C are schematically explaining how multi-fed cards are delivered from the rotary unit.
Figure 12B:
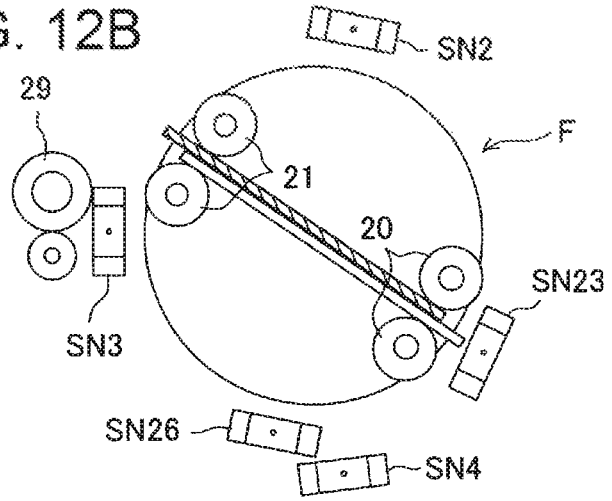
Figure 12C:
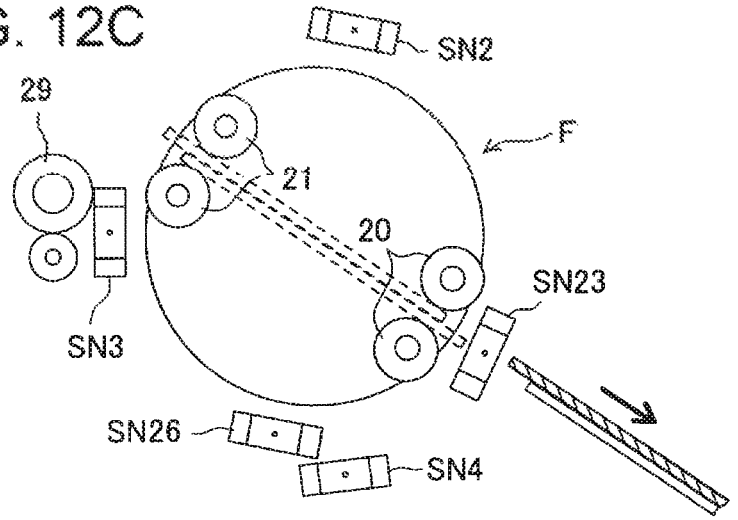

If Yes in Step S330, the center part of the multi-fed cards is positioned at the rotation center in Step S340. (FIG. 12A illustrates the multi-fed cards further fed from the position shown in FIG. 11C and rotated toward the sensor SN3 in Step S406 of FIG. 9, and FIG. 12B and FIG. 12C also illustrate the multi-fed cards still further fed.) In the next Step S342, the multi-fed cards are rotated toward the rejected-sheet stacker 54 (see FIG. 12B) since the rotary unit F is found rotatable in Step S316. In Step S344, the rollers 20 and rollers 21 are rotated, delivering the multi-fed cards into the rejected-sheet stacker 54 (see FIG. 12C). The process then goes to Step S346. When the sensor SN23 detects the rear ends of the multi-fed cards, the CPU confirms that the multi-fed cards have been delivered into the rejected-sheet stacker 54.

(1-6) Card Delivery if Rollers are Unable to Rotate

In the printing apparatus 1 according to this embodiment, if the rotary unit F is rotated while the rollers 20 and rollers 21 are holding multi-fed cards, these cards may interfere with the sensors arranged around the rotary unit F, and the rotary unit F may no longer rotate. In view of this, the printing apparatus 1 has a mode of conveying the multi-fed cards back to the medium supplying section C (to the upstream side), without rotating the rotary frame F. The operator may select this mode at the operation panel unit 5 (or host apparatus 101).

If Yes in Steps S302, S312 and S316, the process goes to Step S348. In Step S348 it is determined whether the mode of conveying the multi-fed cards back to the medium supplying section C without rotating the rotary frame F has been selected or not. If No in Step S348, the process goes to Step S358. If Yes in Step S348, the process goes to Step S350. In Step S350, it is determined, from the output of the sensor lever 69 (see FIG. 3), whether the medium supplying section C (more precisely, card cassette) has been removed from the cassette-holding area 68, namely whether the cards can be delivered or not.

Figure 14:
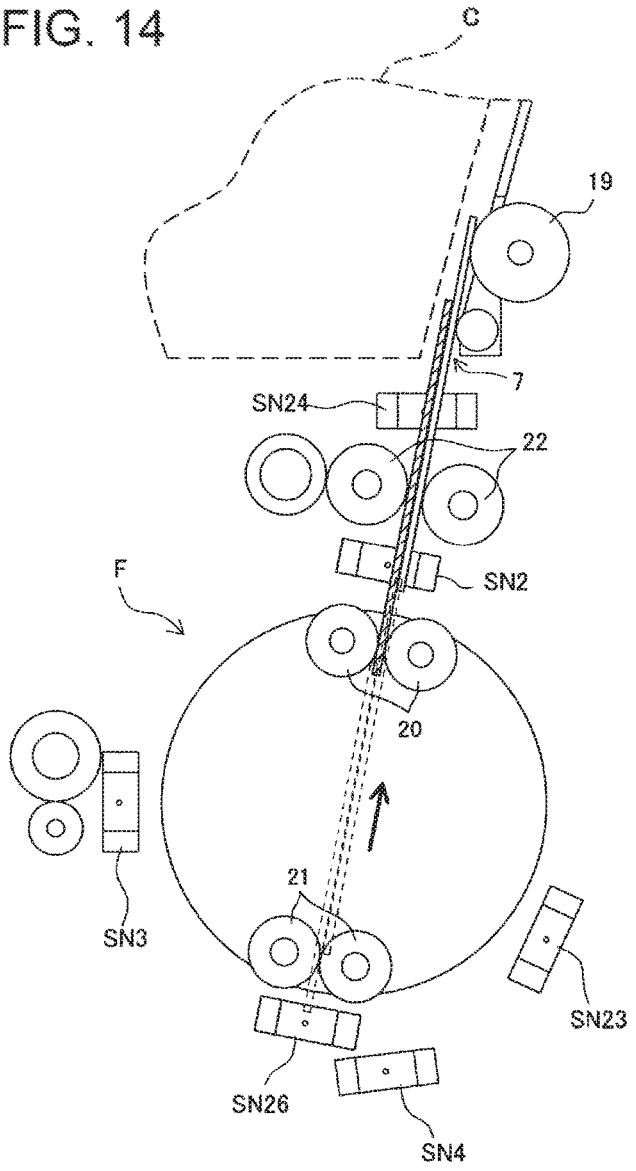
FIG. 14 is a diagram schematically showing how the multi-fed cards are sent back to the medium supplying section.

If No in Step S350, the process goes to Step S352. In Step S352, the operation panel unit 5 (more precisely, monitor 102 connected to the host apparatus 101 via the communications unit 71) displays, through the operation display control unit 76, a message prompting the operator to remove the card cassette. Then, the process returns to Step S350. (If No in Step S350 and in the loop of Step S352, the buzzer operating circuit 78 is driven for a preset period of time, causing a buzzer 6 to generate an alarm to the operator.) If Yes in Step S350, the process goes to Step S354, in which the first card-conveyance motor is driven in the reverse direction, conveying the multi-fed cards back to the medium supplying section C, and the process goes to Step S356. FIG. 14 shows the multi-fed cards conveyed in Step S354 back to the medium supplying section C.

(1-7) Efficiency of the Unjamming

In Steps S346, S356 and S358, the CPU makes the operation panel unit 5 (more precisely, monitor 102) display an error message. In accordance with this message, the operator starts solving the problem as will be described below.

(a) In Step S358, the buzzer 6 is activated for a prescribed time, and the operation panel unit 5 displays an error message (informing the operator that two or more cards are being multi-fed, and telling the operator to unjam the printing section B). Then, the card supplying subroutine and the card issuing routine are interrupted.

The operator removes the medium supplying section C from the cassette-holding area 68, opens the front door 12 and opening-closing member 66, and manually rotates the unjamming dial, thereby unjamming the printing section B (as in the conventional printing apparatus). Before opening the front door 12, the operator stops the supply of the commercial available power to the power supply section 80, thereby ensuring the safety. After unjamming the printing section B, the operator closes the front door 12 and the opening-closing member 66 and secures the medium supplying section C in the cassette-holding area 68, thus setting the printing apparatus 1 back to the initial state. Then, the operator turns on the power supply switch, supplying electric power to the printing apparatus 1 again. The print data and magnetic and electric record data is thereby transmitted from the host apparatus 101 to the printing apparatus 1 (more precisely, to memory 77). Thus, the printing apparatus 1 is initialized after the jamming is eliminated in accordance with the error message displayed in Step S358.

(b) In Step S356, the buzzer 6 generates an alarm different from the alarm generated in Step S352, and the operation panel unit 5 (more precisely, monitor 102) displays a message telling the operator that two or more cards have been multi-fed and then conveyed back together. Then, the card supplying subroutine and the card issuing routine are interrupted. The operator removes the medium supplying section C from the cassette-holding area 68 and then takes the multi-fed cards (conveyed back in Step S354) out of the upper part of the printing apparatus 1, thereby unjamming the printing section B. The operator closes the opening-closing member 66 and sets the medium supplying section C back to the cassette-holding area 68.

(c) In Step S346, the operation panel unit 5 (more precisely, monitor 102) displays a message telling that a multi-feed has occurred and that milt-fed cards have been delivered to the rejected-sheet stacker 54. (The buzzer 6 is not activated). The card supplying subroutine and the card issuing routine are interrupted. Now that the multi-fed cards have been delivered to the rejected-sheet stacker 54, the operator need not perform unjamming.

Hence, as seen from the unjamming efficiencies required in Steps S346, S356 and S358, respectively, the operator's unjamming labor can be gradually reduced in the order these steps are mentioned.

The card supplying process (S204) is performed along with the primary transfer process (S202) in the card issuing routine (see FIG. 7). Therefore, the CPU determines the error, i.e., multi-feeding, during the primary transfer process. Upon determining the multi-feeding, the CPU stops the process of forming an image in the image forming region of the image forming unit B1, and terminates the card issuing routine. When the card issuing routine is performed again (from the beginning), the image forming region is handled as a used one. If Yes in Step S302, however, the image forming region is treated as an unused one when the card issuing routine is performed again, because the transfer film 46 is being conveyed (namely, the cueing is undergoing) before the platen roller 45 is pressed onto the thermal head 40.

(2) Recording Process

If the card supplying process (1) is normally finished, the CPU performs the recording process (2). In the recording process, the magnetic and electric record data desired to be recorded in the information recording section A are output and recorded in the card Ca. After the data are so recorded, the first card-conveyance motor is driven, conveying the card Ca, positioning the center part of the card Ca at the rotation center O (namely, setting the center part of the card Ca at the same distance from the nip of the rollers 20 as from the nip of the rollers 21). It is then determined whether a desirable information recording section A is available or not. If Yes, the rotary unit F is rotated toward the information recording section, and the same process as first performed in the information recording section A as desired is then performed. If No, the recording process is terminated.

In the information recording section A, the data is read from the card Ca and compared with the data that should be recorded, performing data verification. In this embodiment, if the verification continuously fails three times, the card Ca is considered having any factor against the data recording, and is delivered, as an erroneous one, into the rejected-sheet stacker 54. At this point, the card supplying process (S204) is performed in parallel with the primary transfer process (Step S202). Therefore, the CPU immediately stops the image forming at the image forming region in the image forming unit B1, as in the case where cards are multi-fed, and then terminates the card issuing routine. When the card issuing routine is performed again, the image forming region is handled as a used one.

(3) Second Card Conveying Process

When the recording process (2) ends, the CPU performs the second card conveying process if the recording process is not designated in the information recording section A (if No in Step S502 shown in FIG. 10). In the second card conveying process, (a) if the recording process is performed in the information recording section A, a card Ca is received from the information recording section A that has performed the recording process last, the first card-conveyance motor is driven, conveying the card Ca, positioning the center part of the card Ca at the rotation center O, the drive motor is driven, rotating the rotary unit F, positioning the card Ca toward the horizontal medium conveyance path P1, and the first and second card-conveyance motors are driven, conveying the card Ca toward the conveyance rollers 29 and conveyance rollers 30. (b) If the recording process in the information recording section A is not designated, the front end of the card Ca exists at the sensing position of the sensor SN3 (the medium conveyance path 65 exists on a line extending from the horizontal medium conveyance path P1), and the first and second card-conveyance motors are driven, conveying the card Ca toward the rollers 29 and rollers 30.

When the sensor SN3 detects the rear end of the card Ca, the CPU stops the first card-conveyance motor. After the sensor SN3 detects the rear end of the card Ca, the CPU supplies a preset number of pulses to the second card-conveyance motor, thereby driving the same, and then stops the second card-conveyance motor. As a result, the card Ca has its ends nipped by the rollers 29 and rollers 30, respectively. The CPU keeps the card Ca waiting at the rollers 29 and rollers 30 until the sensor Se3 detects the marks formed on the image forming region of the transfer film 46, so that the card Ca and the image formed in the image forming region of the transfer film 46 may reach the transfer unit B2 at the same time. When the sensor Se3 detects the marks, the second card-conveyance motor is driven again, conveying the card Ca toward the transfer unit B2.

As shown in FIG. 7, the transfer unit B2 performs a secondary transfer process, transferring the image from the transfer surface of the transfer film 46 to one side of the card Ca. Prior to the secondary transfer process, the CPU controls a heat controller 33, raising the temperature of the heater incorporated in the heat controller 33 to a prescribed value.

The transfer film 46 subjected to the secondary transfer process is separated (or peeled) from the card Ca by the peeling pin 79 (see FIG. 2) arranged between the heat roller 33 and the conveyance rollers 37, and is then conveyed toward the supply roll 47. Meanwhile, the card Ca having the image transferred is conveyed in the horizontal medium conveyance path P2 toward the de-curling mechanism G that is located downstream. The CPU keeps driving the second card-conveyance motor, and stops the second card-conveyance motor after the rear end of the card Ca passes the peeling pin 79 (see FIG. 2). The card Ca is thereby nipped by the rollers 37 and rollers 38.

In the next Step S208, the eccentric cam 36 is rotated, pushing down the de-curling unit 34 toward another de-curling unit 35. The de-curling units 34 and 35 therefore clamp the card Ca between them. The card Ca is thereby de-curled and straightened up. Then, the process goes to Step S210.

2-2. Printing on the Other Side of the Card

In Step S210, it is determined whether data should be printed on both sides of the card. If No, the process jumps to Step S220. If Yes, the process goes to Step S212. In Step S212, the image forming unit B1 performs the primary transfer process as in Step S202, forming an image (i.e., mirror image) on the next image forming region of the transfer film 46 for the other side (e.g., reverse side) of the card. Then, the process goes to Step S216.

While the primary transfer process is being performed in Step S212, the CPU controls the medium supplying section C, thereby conveying the card Ca nipped by the rollers 37 and rollers 38 from the de-curling mechanism G to the rotary unit F through the horizontal medium conveyance paths P2 and P1. The card Ca held by the rollers 20 and rollers 21 is rotated by 180° (thereby turning the card Ca upside down) and is then conveyed toward the conveyance rollers 29 and conveyance rollers 30. In the next Step S216, the secondary transfer process is performed in the transfer unit B2 in the same way as performed in Step S206, thereby transferring the image from the next image forming region of the transfer film 46 to the other side of the card Ca.

Then, in Step S218, the de-curing process is performed in the same way as in Step S208, straightening up the card Ca. In the next Step S220, the card Ca is delivered toward the stacker 60, and the card issuing routine is terminated.

3. Advantages and Modifications

The advantages of the printing apparatus 1 according to this embodiment will be described below.

3-1. Advantages

In the printing apparatus 1 according to this embodiment, the CPU controls the first card-conveyance motor (in Step S314), conveying the card Ca into the rotary unit F, and then determines (in Step S316) whether the sensor SN26 has detected the card Ca, thereby determining whether the rotary unit F can rotate with the card Ca nipped by the rollers 20 and rollers 21. Thus, without conveying the card Ca to the sensor SN26, the CPU can determine whether the rotary unit F can rotate or not. This can shorten the process time for conveying the card. In recent years, the heat each heating element of the thermal head 40 generates per unit time has increased, and the transfer film 46 has been improved to cope with this trend. This decreases the primary transfer process time of Step S202 in FIG. 7. Since the primary transfer process is performed together with the card supplying process in this embodiment, the process time of the printing apparatus 1 can be shortened.

In the printing apparatus 1 according to this embodiment, it is determined, based on the output of the sensor SN26, whether the rotary unit F nipping the card Ca can be rotated or not. The rotary unit F is then rotated toward the designated information recording section A, and it is determined whether cards are multi-fed or not, and the card is conveyed to the information recording section A. (In Step S316 it is determined whether the rotary unit F can be rotate, and in Step S330 it is determined whether cards are multi-fed). That is, the rotary unit F holding the card Ca is rotated if it is found rotatable from the output of the sensor SN26, and it is then determined whether cards are multi-fed or not during conveyance for the next process. Therefore, the process efficiency can be enhanced. (That is, the information recording section A can keep recording information, without rotating the rotary unit F, after the multi-feeding is detected, and the process time can be shortened.) Even if cards Ca are found multi-fed, they can be conveyed back toward the rotary unit F and then be delivered as erroneously fed cards, because it has already been determined that the rotary unit F can be rotated.

In the printing apparatus 1 according to this embodiment, the card Ca is rotated and conveyed into the rotary unit F (Step S314) and conveyed in the directions of the sensors SN3, SN23 and SN4 and SN26. The distance Ld the card Ca is conveyed from the time when the conveyance starts to the time when the card is detected by any one of these sensors is detected. Therefore, no errors are made in detecting the distance Ld even if the card Ca is transferred from the cleaning rollers 22 to the rollers 20. Hence, the distance Ld the card is conveyed can be accurately detected (any multi-feeding of cards can be accurately determined) in the printing apparatus 1 according to this embodiment.

In the printing apparatus 1 according to this embodiment, the sensor S26 is arranged closer to the rotary unit F than the sensor SN3. Therefore, the card Ca nipped by the rollers 20 and rollers 21 of the rotary unit F can be determined rotatable if the sensor SN26 does not detect the front end of the card Ca when the card Ca is conveyed into the rotary unit F. Hence, in the printing apparatus 1 according to this embodiment, whether the rotary unit F is rotatable can be correctly determined from the output of the sensor SN26 before the card conveyance distance Ld is determined, regardless of the error in conveying the card Ca from the cleaning rollers 22 to the rollers 20.

In the printing apparatus 1 according to this embodiment, if the card conveyance distance Ld is shorter than the preset distance L1 (if Yes in Step S330), the rotary unit F is rotated and the rollers 20 and rollers 21 are driven, thereby positioning the rotary unit F so that the card Ca may be removed. This can enhance the unjamming efficiency.

In the printing apparatus 1 according to this embodiment, the multi-fed cards nipped by the rollers 20 and rollers 21 have their center parts positioned at the rotation center O of the rotary unit F. Therefore, the multi-fed cards can be rotated by a larger angle than otherwise.

In the printing apparatus 1 according to this embodiment, the multi-fed cards are conveyed toward the rejected-sheet stacker 54 if the rotary unit F holding the cards can rotate, and the multi-fed cards are conveyed toward the medium supplying section C if the rotary unit F cannot rotate. This more enhances the efficiency of the operator's unjamming than in the case the operator rotates an unjamming dial as in the conventional printing apparatus.

3-2 Modification

In the embodiment described above, the sensor SN2 is exemplified as third sensor. This invention is not limited to the embodiment, nevertheless. For example, before the card Ca is conveyed into the rotary unit F, it may be conveyed for a preset distance after the sensor SN24 detects one end of the card Ca. If the card Ca is conveyed for the preset distance after its rear end is detected, a conveyance error can be eliminated as the card Ca is fed from the cleaning rollers 22 to the rollers 20. This can enhance the accuracy of determining whether the rotary unit F can be rotated as in the case where the sensor SN 2 detects the rear end of the card Ca.

In the embodiment described above, the sensor SN26 is positioned closer to the rotary unit F than the sensor SN3. This invention is not limited to this, nonetheless. The sensor SN26 may be positioned at the same distance from the rotary unit F as the sensor SN3.

In the embodiment described above, the sensor SN23 detects the multi-feeding of cards Ca before the cards are conveyed to the noncontact IC recording unit 23 (Steps S420 to S430, and Step S330). This invention is not limited to this. For example, a sensor may be arranged for the noncontact IC recording unit 23 as the sensors SN26 and SN4 may be arranged around the rotary unit F, respectively for the contact IC recording unit 27 and the magnetic recording unit 24. Then, the card Ca need not be conveyed back from the sensor SN23 beyond the rotation center O of the rotary unit F (namely, first card-conveyance motor need not be driven in the reverse direction), and the card conveyance time (i.e., time the first card-conveyance motor is driven in the forward direction) can be shortened.

In this embodiment, the multi-fed cards can be delivered in the directions of the rejected-sheet stacker 54 and the medium supplying section C. This invention is not limited to this embodiment. Nor the cards need be delivered to the rejected-sheet stacker 54 from any particular position.

Figure 16A:
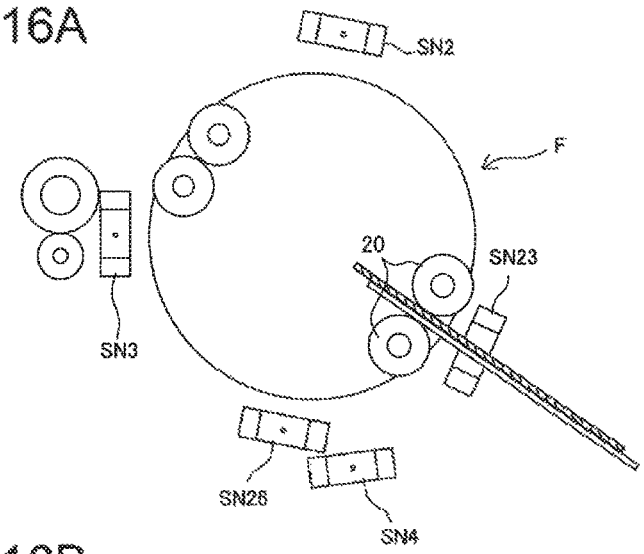
FIGS. 16A to 16C are schematic views showing another embodiment, in which multi-fed cards are so positioned to be delivered.

As shown in FIG. 16A, the multi-fed cards may be nipped by the rollers 20 or rollers 21 positioned near the sensor SN23, not delivered to the rejected-sheet stacker 54. If the rollers 20 or rollers 21 are stopped rotating in this state, the operator needs only to pull the cards from the rollers 20 or rollers 21. This not only enhances the unjamming efficiency, but also prevents any card (found as unfit for data recording, in the information recording section A) from mixing with the multi-fed cards.

To prevent such card mixing, another stacker for receiving multi-fed cards may be secured to the housing 2, above the rejected-sheet stacker 54, and the multi-fed cards conveyed from the rollers 20 (shown in FIG. 2) in the horizontal direction may be delivered to the other stacker. In this case, a sensor may be used to detect the rear ends of the cards, thereby to determine that the cards have been delivered to the other stacker. To prevent dust or the like from entering the housing 2, a plate-shaped member may be driven to open and close the outlet port of the housing 2, by an electromagnetic solenoid or a mini-motor.

Figure 16B:
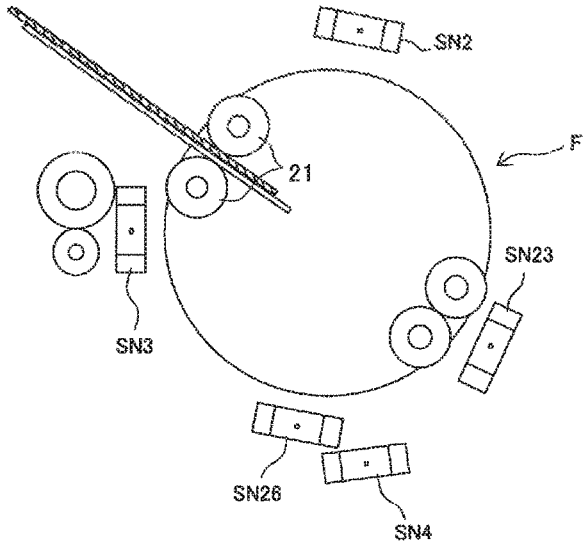

In this embodiment, the three recording units constituting the information recording section A are optional components. Hence, the multi-fed cards may be nipped at one end by the rollers 20 or rollers 21 as shown in FIG. 16B if the noncontact IC recording unit 23 is not used. In this case, the unjamming can be easily performed, merely by opening the upper cover 67 of the opening-closing member 66. If the noncontact IC recording unit 23 is incorporated in the opening-closing member 66, the unjamming can be easily performed from above if the upper cover 67 is opened.

Figure 16C:
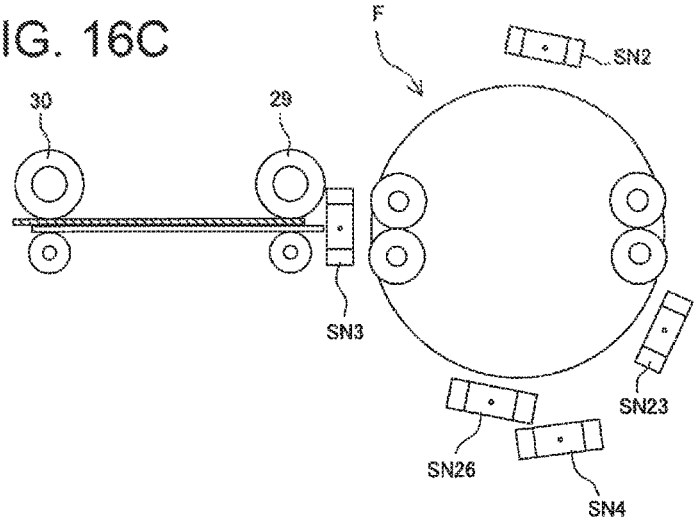

As shown in FIG. 16C, the multi-fed cards conveyed may be kept nipped by the conveyance rollers 29 and conveyance rollers 30. In this case, too, the operator can make an easy access to these cards. The unjamming efficiency is therefore higher than in the case where the cards are held in the rotary unit F. Further, the cards may be conveyed to the medium storing section D.

In the embodiment described above, the rotary unit F is a device for changing the direction of conveying the card Ca. However, this invention can, of course, be applied to a device for rotating the card by an angle smaller than 180°, as is disclosed in Patent Document 3.

In the embodiment described above, the recording units constituting the information recording section A are optional components. Further, the sensor SN4 arranged around the rotary unit F may also be an optional component. That is, the printing apparatus 1 may not incorporate the recording units or the sensor SN4 when it is shipped from the factory, and in the retail shop, the recording units and the sensor SN may be incorporated into the printing apparatus 1 in accordance with the user's request.

In the embodiment, the printing apparatus (image forming apparatus) is an indirect printing type. Nevertheless, this invention is not limited to this type, and can be applied to a direct printing type. Further, in the embodiment, the platen roller 45 is pressed onto the thermal head 40 in the image forming unit B1. Instead, the thermal head 40 may be pressed onto the platen roller 45. In this case, the platen need not be of the type exemplified, but the platen should preferably be a type that would not impair the conveyance of the transfer film 46 or the ink ribbon 41. Moreover, in the embodiment, the heat roller 33 is pressed onto the platen roller 31 in the transfer unit B2. Instead, the platen roller 31 may be pressed onto the heat roller 33.

In the embodiment, an image to be formed on one side of the card Ca is formed in the image forming region of the transfer film 46 in the image forming unit B1 (S202), the image is transferred to one side of the card Ca in the transfer unit B2 (S206), an image to be formed on the other side of the card Ca is formed on the next image forming region of the transfer film 46 in the image forming unit B1 (S212), the card Ca is conveyed, at the same time, to the rotary unit F and is rotated by 180° (S214), and the image is transferred to the other side of the card Ca in the transfer unit B2 (S216). Instead, an image to be formed on one side of the card Ca may be formed in the image forming region of a transfer film 46 in the image forming unit B1, an image to be formed on the other side of the card Ca may then be formed in the next image forming region of the transfer film 46, the image may be transferred to one side of the card Ca in the transfer unit B2, the card Ca may be conveyed to the rotary unit F and be rotated by 180°, and the image may be transferred to the other side of the card Ca.

In the embodiment, the printing apparatus receives the print data and the magnetic and electric record data from the host apparatus 101. This invention is not limited to the embodiment, nevertheless. If the printing apparatus 1 is a member of a local network, it may receive data from not only the host apparatus 101, but also a computer connected to the local network. Also, the magnetic and electric record data may be input via the operation panel unit 5. Further, if the printing apparatus 1 is connected to an external data storage medium such as a USB memory or a memory card, it can acquire the print data and the magnetic and electric record data by fetching information from the external data storage medium. Still further, the printing apparatus 1 may receive image data (Bk image data and R, G and B color image data) instead of print data (Bk print data and Y, M and C color print data) from the host apparatus 101. In this case, the image data received may be converted to print data in the printing apparatus 1.

In the embodiment, it is determined only once whether cards are multi-fed. Whether cards are multi-fed may be determined when they pass by the sensor SN26, the sensor SN3, the sensor SN4 and the sensor SN23. The multi-fed cards cannot be considered multi-fed if they are completely aligned at both ends. They may, however, be displaced one from another when data is recorded on one of them. Therefore, they may be determined to be multi-fed when they are further conveyed (for example, toward the sensor SN3 to receive an image from the transfer film).

This application is based upon and claims the benefit of priority from the prior Japanese Patent Applications Nos. 2016-206658 and 2016-206659, the entire contents of which are incorporated herein by reference.

What is claimed is:

1. A medium conveying apparatus comprising:

a conveyance section configured to convey a medium;

a first conveyance path configured to convey the medium, a second conveyance path arranged to cross the first conveyance path and configured to convey the medium, a direction changing section provided at a point between the first conveyance path and the second conveyance path and configured to change a direction in which the medium is conveyed;

a first sensor arranged downstream the direction changing section, on the first conveyance path;

a second sensor arranged upstream the direction changing section, on the first conveyance path; and a control section configured to control the conveyance section and the direction changing section, wherein the control section controls the conveyance section, thereby to convey the medium into the direction changing section, and determines whether the first sensor has detected the medium, and wherein the control section judges whether the medium is detected by the first sensor at a time when the medium is transferred for a preset distance since the second sensor detects the medium, and if the medium is not detected by the first sensor, the control section actuates the direction changing section to direct the medium to the second conveying path to convey the medium to the second conveying path.

2. The medium conveying apparatus according to claim 1, which further comprises a third sensor arranged on the circumference of the direction changing section and on the second medium conveyance path for conveying the medium in another direction different from that of the medium conveyance path; and in which the first sensor is arranged at a same distance from the direction changing section as the third sensor, or at a shorter distance from the direction changing section than the third sensor.

3. The medium conveying apparatus according to claim 2, wherein unless the first sensor detects the medium conveyed into the direction changing section, conveyed for a preset distance therein and stopped therein, the control section first controls the conveyance section and the direction changing section, thereby changing the direction of conveying the medium toward the second conveyance path, then controls the conveyance section, thereby conveying the medium toward the third sensor arranged on the second conveyance path, and further detects a distance the medium has been conveyed from the time when the conveyance section starts conveying the medium to the time when the third sensor detects the medium.

4. The medium conveying apparatus according to claim 3, wherein the control section determines whether two or more media have been multi-fed, from the distance the media have been conveyed.

5. The medium conveying apparatus according to claim 4, wherein the conveyance section has a pulse motor as a drive source for conveying the medium, and the control section determines whether the media have been multi-fed, from a number of drive pulses supplied to the pulse motor from the time when the conveyance section starts conveying the medium to the time when the second sensor detects front ends of the media.

6. The medium conveying apparatus according to claim 4, wherein if the media are found multi-fed, the control section controls the conveyance section to convey the media back to the direction changing section.

7. The medium conveying apparatus according to claim 1, wherein the control section controls the conveyance section, thereby conveying the medium toward the direction changing section from the time when the second sensor detects a rear end of the medium, and then conveying the medium into the direction changing section for a preset distance.

8. The medium conveying apparatus according to claim 1, wherein unless the first sensor detects the medium when the medium is conveyed for the preset distance toward the direction changing section, the control section controls the direction changing section to change the direction of conveying the medium, thereby to convey the medium toward the second conveyance path.

9. The medium conveying apparatus according to claim 1, wherein if the first sensor detects the medium when the medium is conveyed for the preset distance toward the direction changing section, the control section controls the conveyance section to convey the medium back upstream the direction changing section, on the medium conveyance path.

10. The medium conveying apparatus according to claim 1, wherein the direction changing section is a rotary member configured to hold and rotate the medium and has pairs of rollers constituting a part of the conveyance section.

11. An image forming apparatus comprising:

an image forming section configured to form an image on the medium; and the medium conveying apparatus according to claim 1.

12. A medium conveying apparatus comprising:

a conveyance section configured to convey a medium;

a direction changing section provided on a medium conveyance path of the conveyance section and configured to change a direction in which the medium is conveyed by the conveyance section;

a first sensor arranged downstream the direction changing section, on the medium conveyance path;

a control section configured to control the conveyance section and the direction changing section; and a second sensor arranged on a circumference of the direction changing section and on another medium conveyance path for conveying the medium in another direction different from that of the medium conveyance path; and in which the first sensor is arranged at a same distance from the direction changing section as the second sensor, or at a shorter distance from the direction changing section than the second sensor, wherein the control section controls the conveyance section, thereby to convey the medium into the direction changing section, and determines whether the first sensor has detected the medium, and wherein unless the first sensor detects the medium conveyed into the direction changing section, conveyed for a preset distance therein and stopped therein, the control section first controls the conveyance section and the direction changing section, thereby changing the direction of conveying the medium toward the another medium conveyance path, then controls the conveyance section, thereby conveying the medium toward the second sensor arranged on the another medium conveyance path, and further detects the distance the medium has been conveyed from a time when the conveyance section starts conveying the medium to a time when the second sensor detects the medium.

* * * * *